US007631521B2

(12) United States Patent
Oya

(10) Patent No.: US 7,631,521 B2
(45) Date of Patent: Dec. 15, 2009

(54) GARMENT HAVING A WARP-KNITTED FABRIC

(75) Inventor: Kei Oya, Kyoto (JP)

(73) Assignee: Wacoal Corporation, Kyoto (JP)

( * ) Notice: Subject to any disclaimer, the term of this patent is extended or adjusted under 35 U.S.C. 154(b) by 993 days.

(21) Appl. No.: 10/535,082

(22) PCT Filed: Apr. 26, 2004

(86) PCT No.: PCT/JP2004/006015

§ 371 (c)(1),
(2), (4) Date: May 13, 2005

(87) PCT Pub. No.: WO2004/100689

PCT Pub. Date: Nov. 25, 2004

(65) Prior Publication Data

US 2006/0053837 A1 Mar. 16, 2006

(30) Foreign Application Priority Data

May 13, 2003 (JP) ..... 2003-134586
Oct. 29, 2003 (JP) ..... 2003-369540

(51) Int. Cl.
*D04B 9/46* (2006.01)

(52) U.S. Cl. ..... 66/172 E; 66/195

(58) Field of Classification Search ..... 66/172 E, 66/172 R, 195, 190, 191, 192, 193; 442/306, 442/312

See application file for complete search history.

(56) References Cited

U.S. PATENT DOCUMENTS 4,244,199 A * 1/1981 Rhode ..... 66/193
5,029,457 A * 7/1991 Gajjar ..... 66/195
5,669,247 A * 9/1997 McCartney et al. ..... 66/195

(Continued)

FOREIGN PATENT DOCUMENTS

EP 1 136 001 A1 9/2001

(Continued)

OTHER PUBLICATIONS

International Search Report for PCT/JP2004/006015 mailed Jun. 8, 2004.

(Continued)

*Primary Examiner*—Danny Worrell
(74) *Attorney, Agent, or Firm*—Darby & Darby PC

(57) ABSTRACT

A garment that is made including a piece of a stretchable warp-knitted fabric, wherein at least a non-elastic yarn is arranged in a 1×1 tricot structure and an elastic yarn is arranged in a looping structure, that is cut at an angle of at least 3° and at most 177° with respect to the knitting direction, the piece having an edge that does not require hem finishing when left as cut, so that at least one of the edge portions of the garment is formed by an edge that does not require hem finishing when left as cut (an edge of the bottom line 2 or an edge of the waist line 3). Thus, a garment is provided, in which the portion of the edge does not become thick, the edge does not require hem finishing when the fabric is left as cut, this edge is used for the garment's edge portion, curling of the edge portion does not occur, and the edge portion fits the body.

48 Claims, 18 Drawing Sheets

U.S. PATENT DOCUMENTS

| | | | | |
|---|---|---|---|---|
| 6,401,497 | B1 * | 6/2002 | Nishiyama et al. | 66/172 E |
| 2001/0042389 | A1 | 11/2001 | Fujiwara | |
| 2002/0106970 | A1 | 8/2002 | Falla | |

FOREIGN PATENT DOCUMENTS

| | | | |
|---|---|---|---|
| JP | 10-259555 | A1 | 9/1998 |
| JP | 11-001853 | A1 | 1/1999 |
| JP | 2000-303331 | A1 | 10/2000 |
| JP | 2003119653 | A1 | 4/2003 |

OTHER PUBLICATIONS

Patent Abstracts of Japan for JP2004-027465 published Jan. 29, 2004.

Patent Abstracts of Japan for JP2000-008203 published Jan. 11, 2000.

Sci Fondo, No. 120, Feb. 1996, pp. 34, 35 with Annex A: English translation of pp. 34, 35 of D3; Annex B: leaflet relating to Sensitive® fabric illustrated on p. 35 of D3; Annex C: representation of the loop construction of the Sensitive® fabric of D3.

* cited by examiner

GARMENT HAVING A WARP-KNITTED FABRIC

CROSS-REFERENCE TO PRIOR APPLICATION

This is a U.S. National Phase application under 35 U.S.C. §371 of International Patent Application No. PCT/JP2004/006015, filed Apr. 26, 2004, and claims the benefit of Japanese Patent Application Nos. 2003-134586, filed May 13, 2003 and 2003-369540, filed Oct. 29, 2003, both of which are incorporated by reference herein. The International Application was published in Japanese on Nov. 25, 2004 as WO 2004/100689 A1 under PCT Article 21(2).

TECHNICAL FIELD

The present invention relates to garments having an edge that does not require hem finishing when left as cut.

BACKGROUND ART

Conventionally, edges, for example a the bottom part of a garment, tend to be frayed if left as cut, so that some sort of hem finishing is necessary in order to prevent fraying. Such finishing, or hem finishing, is referred to as hemming, and there are various hemming methods, depending on position and material. For example, hem finishing is ordinarily performed by folding over a cloth edge and sewing the two layers together, or another cloth or tape-like member is formed to a substantially U-shaped cross-section and put over the edge portion of the fabric, and they are sewed together. However, this operation causes a considerable burden in the sewing of garments. Furthermore, if hem finishing is performed in this manner, then this portion becomes thick, and in cases in which tight outerwear is worn over it, the hemline of the underwear is visible as a convex rib through the outerwear, which worsens the outer appearance, and there is the problem that the thicker edge portion impairs wearing comfort. Furthermore, conventionally, a method of forming an edge portion by pulling out yarn was often performed in order to form an edge that does not require hem finishing, if one vertically continuous piece was used for the garment (see FIG. 2 and paragraphs [0019] and [0020] of Patent Document 1; FIG. 3 and paragraph [0014] of Patent Document 2; FIG. 1 and paragraph [0020] of Patent Document 3). To form an edge portion by pulling out yarn, the lines at the upper and lower edge portions of the piece must be parallel, and there was the restriction that if a piece in which the lines of the upper and lower edge portions are not parallel is used for garments, then at least one side must be hem finished.

To address this problem, in recent years, garments have come to be used, which use a piece made of a fabric not requiring hem finishing for at least a portion of the fabric constituting the garment, such that, for example in a girdle or the like having for example a bottom line not requiring hem finishing, the edge portion of the fabric not requiring hem finishing serves as the bottom portion of the girdle. However, there was the problem that curling occurs at the edge portion, so that the edge portion fits the body poorly.

Patent Document 1: JP 2000-303331A

Patent Document 2: Japanese Patent 2997432

Patent Document 3: Japanese Patent 3054384

It is an object of the present invention to solve these conventional problems, and to provide a garment with an edge portion shape that can be freely adjusted to the shape of a body in contact with it, by using a piece that does not require hem finishing when left as cut, and which has the advantages of a garment having an edge that does not require hem finishing, such as that step differences (level differences) reflecting the bottom line or the waist line on an outer garment do not appear, while the degree of freedom of design is increased and the portion of the edge does not become thick, and the garment fitting the body without the edge portion of the garment curling.

SUMMARY OF THE INVENTION

To attain this object, a garment according to the present invention is made including a piece of a stretchable warp-knitted fabric, comprising at least a non-elastic yarn arranged in a 1×1 tricot structure and an elastic yarn arranged in a looping structure, the piece being cut at an angle of at least 3° and at most 177° with respect to a knitting direction, the piece having an edge that does not require hem finishing when left as cut, so that at least one of the edge portions of the garment is formed by an edge that does not require hem finishing when left as cut.

Figure 1:
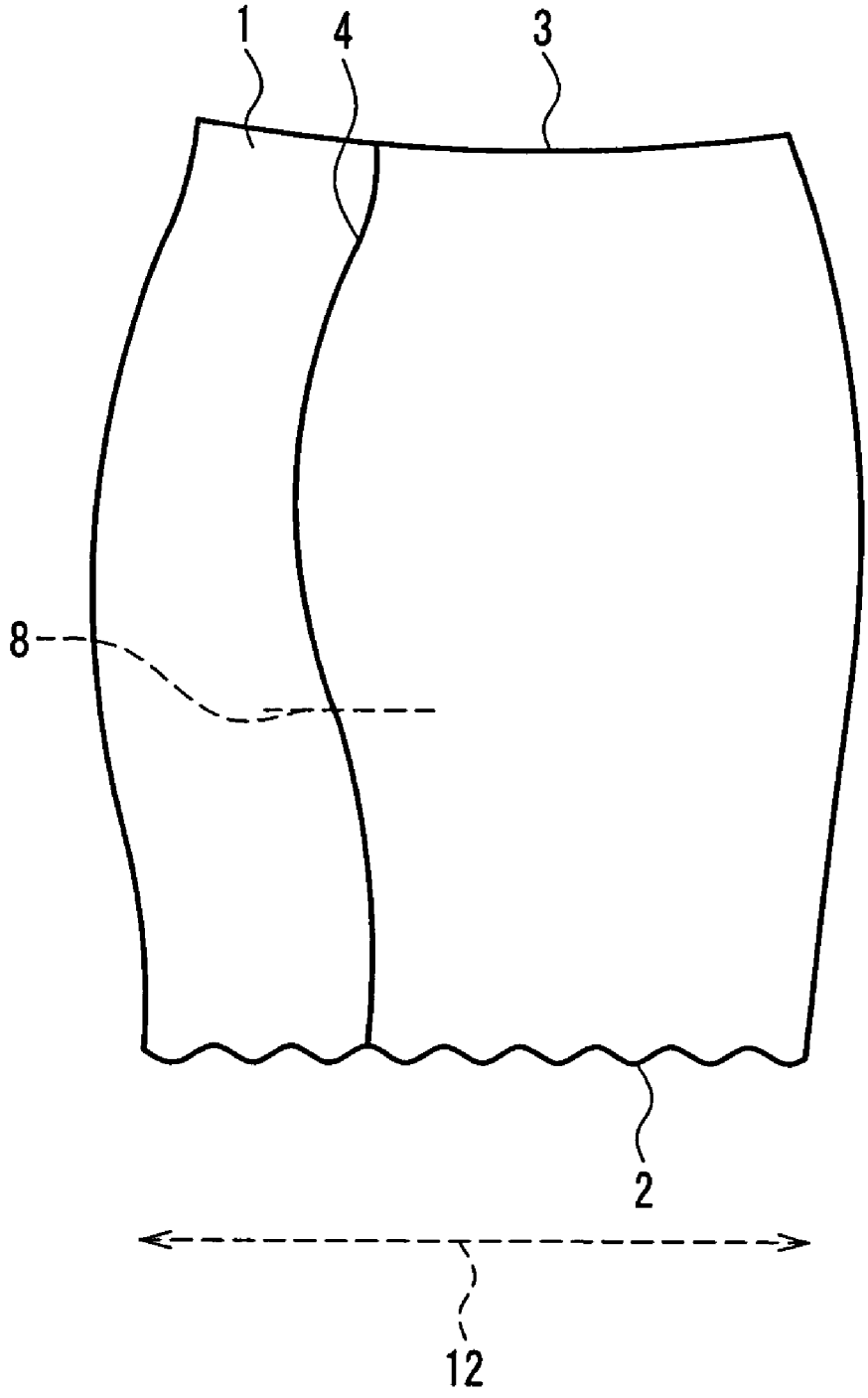
FIG. 1 is a perspective view showing a semi-long type girdle according to an embodiment of the present invention of a garment that has an edge that does not require hem finishing when left as cut, seen from the rear side of the present invention.

DETAILED DESCRIPTION OF THE INVENTION (1) A garment according to the present invention is made including a piece of a stretchable warp-knitted fabric, comprising at least a non-elastic yarn arranged in a 1×1 tricot structure and an elastic yarn arranged in a looping structure, the piece being cut at an angle of at least 3° and at most 177° with respect to a knitting direction, the piece having an edge that does not require hem finishing when left as cut, so that at least one of the edge portions of the garment is formed by an edge that does not require hem finishing when left as cut.

The garment of the present invention is made from a piece of cloth that does not require hem finishing when left as cut, so that a garment can be provided that has edges not requiring hem finishing, in which step differences reflecting the bottom line or the waist line on an outer garment are not apparent, while the portion of the edge does not become thick. Moreover, either the upper or the lower or both edge portions of the garment can be made edges that do not require hem finishing, the degree of freedom of design of the garment can be increased, the garment fits the body without curling of the garment's edge portions, the garment has stretchability and high wearing comfort.

In the garment according to the present invention, by cutting a stretchable warp-knitted fabric, which comprises at least a non-elastic yarn arranged in a 1×1 tricot structure and an elastic yarn arranged in a looping structure, at an angle of at least 3° and at most 177° with respect to the knitting direction, it is possible to form an edge that does not fray and that does not require hem finishing when left as cut, and when the garment is formed including a piece having an edge that does not require hem finishing when left as cut, so that at least one of the edge portions of the garment is formed by an edge that does not fray and that does not require hem finishing when left as cut, then a garment can be obtained in which the edge portions do not require hem finishing, and the edge portions are flat and do not constitute a level difference. Moreover, a garment can be provided, in which the edge portions of the garment do not curl, that fits the wearer's body, that has stretchability, and that has high wearer comfort.

(2) In the garment of according to (1), it is preferable that the warp-knitted fabric has a 1×1 tricot structure in which the non-elastic yarn and the elastic yarn run in the same direction, and both the elastic yarn and the non-elastic yarn form open loops.

(3) In the garment of according to (1), it is preferable that the warp-knitted fabric has a 1×1 tricot structure in which the non-elastic yarn and the elastic yarn run in different directions, and at least one of the elastic yarn and the non-elastic yarn forms closed loops.

(4) In the garment of according to (1), it is preferable that the warp-knitted fabric has a 1×1 tricot structure in which the non-elastic yarn and the elastic yarn run in different directions, and both the elastic yarn and the non-elastic yarn forms closed loops.

(5) In the garment of according to (1), it is preferable that the structure of the elastic yarn is a half structure.

(6) In the garment of according to (1), it is preferable that the structure of the elastic yarn is an atlas structure.

(7) It is preferable that the garment of according to (5) or (6) is made of a warp-knitted fabric wherein at least one of the elastic yarn and the non-elastic yarn forms closed loops.

(8) It is preferable that the garment of according to (5) or (6) is made of a warp-knitted fabric wherein both of the elastic yarn and the non-elastic yarn form closed loops.

(9) In the garment of according to (5) or (6), it is preferable that the non-elastic yarn is a cotton yarn.

(10) In the garment of according to (5), it is preferable that the non-elastic yarn is a cotton yarn.

(11) In the garment of according to (5), it is preferable that the non-elastic yarn is a cotton yarn, and at least one of the elastic yarn and the non-elastic yarn forms closed loops.

(12) In the garment of according to (5), it is preferable that the non-elastic yarn is a cotton yarn, and both of the elastic yarn and the non-elastic yarn form closed loops.

(13) In the garment of according to (1), it is preferable that the piece is a piece that is laminated by bonding at least one material selected from a group (A) consisting of (A-1) and (A-2) listed below to a material made of a cloth other than (A-1) and (A-2), where (A-1) is a warp-knitted fabric wherein both the non-elastic yarn and the elastic yarn are arranged in a 1×1 tricot structure and run in the same direction, and both the elastic yarn and the non-elastic yarn form closed loops;

where (A-2) is a warp-knitted fabric wherein both the non-elastic yarn and the elastic yarn are arranged in a 1×1 tricot structure and run in the same direction, and one of the elastic yarn and the non-elastic yarn forms closed loops and the other one forms open loops.

(14) In the garment of according to (13), it is preferable that the material from which said other cloth is made is at least one material selected from a group (B) consisting of (B-1) to (B-4), where (B-1) is a warp-knitted fabric wherein the non-elastic yarn is arranged in a 1×1 tricot structure and the elastic yarn is arranged in a half structure;

(B-2) is a warp-knitted fabric wherein the non-elastic yarn is arranged in a 1×1 tricot structure and the elastic yarn is arranged in an atlas structure;

(B-3) is a warp-knitted fabric wherein both the non-elastic yarn and the elastic yarn are arranged in a 1×1 tricot structure and run in the same direction, and both the non-elastic yarn and the elastic yarn form open loops;

(B-4) is a warp-knitted fabric wherein the non-elastic yarn and the elastic yarn run in different directions, and both the non-elastic yarn and the elastic yarn are arranged in a 1×1 tricot structure and form closed loops.

(15) In the garment of according to (1), it is preferable that the piece is a piece that is laminated by bonding together a plurality of sheets of at least one material selected from a group (B) consisting of (B-1) to (B-4), where (B-1) is a warp-knitted fabric wherein the non-elastic yarn is arranged in a 1×1 tricot structure and the elastic yarn is arranged in a half structure;

(B-2) is a warp-knitted fabric wherein the non-elastic yarn is arranged in a 1×1 tricot structure and the elastic yarn is arranged in an atlas structure;

(B-3) is a warp-knitted fabric wherein both the non-elastic yarn and the elastic yarn are arranged in a 1×1 tricot structure and run in the same direction, and both the non-elastic yarn and the elastic yarn form open loops;

(B-4) is a warp-knitted fabric wherein the non-elastic yarn and the elastic yarn run in different directions, and both the non-elastic yarn and the elastic yarn are arranged in a 1×1 tricot structure and form closed loops.

(16) In the garment of according to (14), it is preferable that the material (A) is (A-1) and the material (B) is (B-1).

(17) In the garment of according to (16), it is preferable that the non-elastic yarn of (B-1) is cotton, and both the non-elastic yarn and the elastic yarn form closed loops.

(18) In the garment of according to any of (1) to (17), it is preferable that at least one of an upper garment edge and a lower garment edge of the piece is an edge that does not require hem finishing when left as cut, and this edge not requiring hem finishing is cut at an angle of 10° to 120° with respect to the knitting direction.

(19) In the garment of according to any of (1) to (17), it is preferable that both an upper garment edge and a lower garment edge of the piece are edges that do not require hem finishing when left as cut, and these edges not requiring hem finishing are cut at an angle of 10° to 120° with respect to the knitting direction.

(20) In the garment of according to any of (1) to (19), it is preferable that the piece is made of warp-knitted fabric that is continuous in vertical direction of the garment.

(21) In the garment of according to any of (1) to (20), it is preferable that at least one of an upper garment edge and a lower garment edge of the piece is an edge that does not require hem finishing when left as cut, and this edge not requiring hem finishing is cut in a curved line.

(22) In the garment of according to any of (1) to (20), it is preferable that both an upper garment edge and a lower garment edge of the piece are edges that do not require hem finishing when left as cut, and these edges not requiring hem finishing are cut in a curved line.

(23) In the garment of according to any of (1) to (21), it is preferable that at least one of an upper garment edge and a lower garment edge of the piece is an edge that does not require hem finishing when left as cut, and this edge not requiring hem finishing has a wave shape of a plurality of curved lines.

(24) In the garment of according to any of (1) to (22), it is preferable that both an upper garment edge and a lower garment edge of the piece are edges that do not require hem finishing when left as cut, and these edges not requiring hem finishing have a wave shape of a plurality of curved lines.

(25) In the garment of according to any of (1) to (24), it is preferable that both an upper garment edge and a lower garment edge of the piece are edges that do not require hem finishing when left as cut, and the upper edge and the lower edge are not parallel to one another.

(26) In the garment of according to any of (1) to (25), it is preferable that both an upper garment edge and a lower garment edge of the piece are edges that do not require hem finishing when left as cut, and a shape of the upper edge is different from a shape of the lower edge.

(27) In the garment of according to any of (1) to (26), it is preferable that the garment is a bottom garment, and the edge of the piece that does not require hem finishing when left as cut forms at least one of a waist and a bottom line.

(28) In the garment of according to any of (1) to (26), it is preferable that the garment is a bottom garment, and the edges of the piece that do not require hem finishing when left as cut form both a waist and a bottom line.

(29) In the garment of according to any of (1) to (26), it is preferable that the garment is a brassiere, or a top of a bathing suit or a leotard, and the edge of the piece that does not require hem finishing when left as cut forms at least one of an upper edge and a lower edge of a back cloth.

(30) In the garment of according to any of (1) to (26), it is preferable that the garment is a brassiere, or a top of a bathing suit or a leotard, and the edges of the piece that do not require hem finishing when left as cut form both of an upper edge and a lower edge of a back cloth.

(31) In the garment of according to (27), it is preferable that the edge of the piece that does not require hem finishing when left as cut is cut at an angle of 20° to 80° with respect to the knitting direction.

(32) In the garment of according to (28), it is preferable that the edges of the piece that do not require hem finishing when left as cut are both cut at an angle of 20° to 80° with respect to the knitting direction.

(33) In the garment of according to (29) or (30), it is preferable that the garment edges of the piece forming the back cloth that do not require hem finishing when left as cut are cut at an angle of 10° to 90° with respect to the knitting direction.

(34) In the garment of according to (29) or (30), it is preferable that the garment edges of the piece forming the back cloth that do not require hem finishing when left as cut are cut at an angle of 75° to 90° with respect to the knitting direction.

(35) In the garment of according to any of (1) to (34), it is preferable that the piece is provided with a Jacquard pattern knitted into a base fabric made of the non-elastic yarn and the elastic yarn constituting the piece, by Jacquard control of another non-elastic yarn serving as the pattern yarn.

(36) In the garment of according to (35), it is preferable that the elastic yarn forming the base knit structure is arranged in a 1×1 tricot structure, and at least one of the non-elastic yarn forming the base knit structure and the non-elastic yarn serving as the Jacquard-controlled pattern yarn is arranged in a 1×1 tricot structure that runs in the same direction as the elastic yarn, and a portion forming the Jacquard pattern in the pattern yarn has a structure other than a 1×1 tricot structure.

(37) In the garment of according to (35), it is preferable that the elastic yarn forming the base knit structure is arranged in a 1×1 tricot structure, and either the non-elastic yarn forming the base knit structure or the non-elastic yarn serving as the Jacquard-controlled pattern yarn is arranged in a 1×1 tricot structure that runs in the same direction as the elastic yarn, whereas the other non-elastic yarn is arranged in a 1×1 tricot structure that runs in a direction that is different to that of the elastic yarn, and a portion forming the Jacquard pattern in the pattern yarn has a structure other than a 1×1 tricot structure.

(38) In the garment of according to (35), it is preferable that the non-elastic yarn forming the base knit structure is arranged in a 1×1 tricot structure that runs in a direction that is different to that of the elastic yarn forming the base knit structure, and the non-elastic yarn serving as the Jacquard-controlled pattern yarn is arranged in a structure that runs in the same direction as the elastic yarn forming the base knit structure, and a portion forming the Jacquard pattern in the pattern yarn has a structure other than a 1×1 tricot structure.

(39) In the garment of according to (1), it is preferable that the piece is a piece that is laminated by bonding at least one material selected from a group (A) consisting of (A-1) and (A-2) listed below to a material made of a piece in which the Jacquard pattern according to any the above-described (35), (36), (37) and (38) is formed, where (A-1) is a warp-knitted fabric wherein both the non-elastic yarn and the elastic yarn are arranged in a 1×1 tricot structure and run in the same direction, and both the elastic yarn and the non-elastic yarn form closed loops.

where (A-2) is a warp-knitted fabric wherein both the non-elastic yarn and the elastic yarn are arranged in a 1×1 tricot structure and run in the same direction, and one of the elastic yarn and the non-elastic yarn forms closed loops and the other one forms open loops.

(40) In the garment of according to any of (29), (30), (33) and (34), it is preferable that the back cloth is a back cloth using a piece according to any of (13) to (17) and (39).

(41) In the garment of according to any of (1) to (40), it is preferable that the piece has a straight boundary line for a stretching power transition region due to the elastic yarn.

(42) In the garment of according to any of (1) to (41), it is preferable that the garment is a garment that fits the body tightly.

In the garment of the present invention, the edge that does not require hem finishing when left as cut is not an edge that does not require hem finishing formed by a method such as the above-described pulling out of yarn, but an edge that is left as cut, using a warp-knitted fabric whose edge does not require hem finishing when left as cut. For the fabric whose cut end (edge that is left as cut) becomes an edge that does not require hem finishing even when left as cut, a stretchable tricot knitted fabric may be used, including at least a non-elastic yarn arranged in a 1×1 tricot structure and an elastic yarn arranged in a looping structure. As long as the elastic yarn arranged in a looping structure like a stretchable tricot, it may also have a structure other than a 1×1 structure (Denbigh structure), such as a half structure or an atlas structure, is also possible.

More specifically, fabrics having the following knitting structure can be used, but there is no limitation to the following, and as long as it is a fabric whose cut end (edge that is left as cut) becomes an edge that does not fray and does not require hem finishing, then the use of fabrics a knitting structure other than those specifically described herein also falls within the scope of the invention.

A knitted fabric constituting a piece that is used for the present invention and that has an edge not requiring hem finishing when left as cut is for example (1) a stretchable warp-knit fabric with a 1×1 tricot structure in which a non-elastic yarn and a elastic yarn run in the same direction, and both the elastic yarn and the non-elastic yarn form open loops at each of the knitting stitches. Using a non-elastic yarn and an elastic yarn for the knitting yarn provides appropriate stretchability. Alternatively, it may be example (2) a stretchable warp-knit fabric with a 1×1 tricot structure in which a non-elastic yarn and a elastic yarn run in different directions, and at least one of the elastic yarn and the non-elastic yarn forms closed loops at each of the knitting stitches. Using a non-elastic yarn and an elastic yarn for the knitting yarn provides appropriate stretchability. By arranging the non-elastic yarn and the elastic yarn in a 1×1 knitting structure, and knitting with at least one of the elastic yarn and the non-elastic yarn forming closed loops at each of the knitting stitches, it is possible to attain stable knitting loops and prevent fraying of edges that are left as cut. It is also possible to knit with both the non-elastic yarn and the elastic yarn forming closed loops.

Moreover, it is preferable to use, as the knitted fabric of the piece, (3) a fabric in which the non-elastic yarn is arranged in a 1×1 tricot structure (Denbigh structure) and the elastic yarn is arranged in a half structure.

Moreover, it is preferable to use, as the knitted fabric of the piece, (4) a fabric in which the non-elastic yarn is arranged in a 1×1 tricot structure and the elastic yarn is arranged in an atlas structure.

In the knitted fabrics of (3) and (4), it is preferable that at least one of the elastic yarn and the non-elastic yarn forms closed loops. In warp-knitted fabrics in which both of the elastic yarn and the non-elastic yarn form closed loops, the prevention of fraying of the edges that are left as cut is favorable, and is thus even more preferable.

It is preferable to use cotton yarn as the non-elastic yarn, in view of touch to the skin and its ability to absorb sweat, but if cotton yarn is used as the non-elastic yarn, then it is preferable to use a warp-knitted fabric of the structure according to above mentioned (3) or (4), because this favorably prevents fraying of edges that are left as cut, and in particular using the structure of (3) is even more preferable. If cotton yarn is used, then fraying of the edges that are left as cut tends to occur more easily than when using nylon yarn or polyester yarn, but using a half structure or an atlas structure, preferably a half structure, for the elastic yarn as noted above, increases the straining power of the elastic yarn, and even when a cotton yarn which tends to fray more easily is used as the non-elastic yarn, fraying of edges that are left as cut is effectively prevented, which is preferable. If cotton yarn is used as the non-elastic yarn in this manner, then it is preferable that at least one of the non-elastic yarn and the elastic yarn forms closed loops, and it is even more preferable to use a warp-knitted fabric in which both the non-elastic yarn and the elastic yarn form closed loops, because this prevents the fraying of the edges that are left as cut even more effectively.

Moreover, for the knitted fabric of the piece having an edge that does not fray easily when left as cut that is used for the present invention, it is possible to use a knitted fabric with a specific knitting structure combining an non-elastic yarn and an elastic yarn as described above, and assuming that this knitted fabric is called "base knit," then it is possible to form a suitable Jacquard pattern, such as a small pattern, by knitting a non-elastic yarn serving as the pattern yarn by Jacquard control. If the non-elastic yarn for forming the pattern that is knitted by Jacquard control is referred to as "pattern yarn," then it is possible to form a Jacquard pattern or the like on a portion where a pattern is to be formed, by knitting the pattern yarn to a structure that is different from the knitting structure of the base knit. The portion where no pattern appears should be knitted with the same structure and running in the same direction as the non-elastic yarn or the elastic yarn of the base knit, for example. It is preferable that, for example, the pattern yarn of the portion where a pattern appears is chain stitched, but there is no limitation to chain stitches, and as long as the base knit has a 1×1 tricot structure in which the elastic yarn and the non-elastic yarn run in the same direction, it may also be a 1×1 tricot structure in which the direction of the sinker loop of the pattern yarn of the portion where the pattern is to appear runs in a direction that is different to that of the direction of the sinker loop of the base knit structure, or it is possible to form a pattern by selecting, as appropriate, a knitting structure that is different from the base knit structure, such as a half structure.

The following examples (a) to (c) are preferable formation examples of Jacquard patterns:

(a) A piece made of a warp-knitted fabric, wherein the elastic yarn forming the base fabric is arranged in a 1×1 tricot structure, and at least one of the non-elastic yarn forming the base knit structure and the non-elastic yarn serving as the Jacquard-controlled pattern yarn is arrange in a 1×1 tricot structure that runs in the same direction as the elastic yarn, and a portion forming the Jacquard pattern in the pattern yarn has a structure that is not a 1×1 tricot structure.

Thus, the locations where the non-elastic yarn serving as the Jacquard-controlled pattern yarn is a 1×1 tricot structure running in the same direction as the elastic yarn are locations that are outside the portions forming the Jacquard pattern. Therefore, a plurality of small patterns can be formed that are discontinuous between pattern and pattern. Also with (b) and (c) below, it is possible to form a plurality of small patterns that are similarly discontinuous between pattern and pattern. Needless to say, it is also possible to form patterns in which some of the small patterns are connected.

(b) A piece made of a warp-knitted fabric, wherein the elastic yarn forming the base knit structure is arranged in a 1×1 tricot structure, and either the non-elastic yarn forming the base knit structure or the non-elastic yarn serving as the Jacquard-controlled pattern yarn is arranged in a 1×1 tricot structure that runs in the same direction as the elastic yarn, whereas the other non-elastic yarn is arranged in a 1×1 tricot structure that runs in a direction that is different to that of the elastic yarn, and a portion forming the Jacquard pattern in the pattern yarn has a structure that is not a 1×1 tricot structure.

(c) A piece made of a warp-knitted fabric, wherein the non-elastic yarn forming the base knit structure is arranged in a 1×1 tricot structure that runs in a direction that is different to that of the elastic yarn forming the base knit structure, and the non-elastic yarn serving as the Jacquard-controlled pattern yarn is arranged in a 1×1 tricot structure that runs in the same direction as the elastic yarn, and a portion forming the Jacquard pattern in the pattern yarn has a structure that is not a 1×1 tricot structure.

As described for (a) to (c) above, in the case of a Jacquard warp-knitted fabric having a Jacquard pattern, a non-elastic yarn is passed through at least two yarn guides, and two kinds of non-elastic yarns are used that may be of the same or different types. By using a 1×1 tricot structure in which at least one non-elastic yarn runs in the same direction as the elastic yarn, fraying of the edge portions that are left as cut tends to occur less. Moreover, by using a 1×1 tricot structure in which the other non-elastic yarn runs in a direction that is different to that of to the elastic yarn, the strength of the knitted fabric is increased, and in particular the tear strength (at which the fabric tears so that it is split from the edge portion into two) can be increased, which is preferable. As for the non-elastic yarns that run in the same direction as or in a direction that is different to that of the elastic yarn, it is possible that the non-elastic yarn forming the base knit portion runs in the same direction as the elastic yarn and the non-elastic yarn forming the Jacquard pattern runs in a direction that is different to that of the elastic yarn, but it is also possible that the non-elastic yarn forming the base knit portion runs in a direction that is different to that of the elastic yarn and the non-elastic yarn forming the Jacquard pattern runs in the same direction as the elastic yarn. In other words, in the embodiment explained above, the non-elastic yarns run in mutually different directions.

Moreover, it is also possible to use a 1×1 tricot structure, in which an elastic yarn and two non-elastic yarns forming a base knit and a Jacquard pattern all run in the same direction. In this case, the fray resistance of the edge portions that are left as cut are even better than in the pieces described above. With regard to tear resistance, the materials having a portion as described above in which yarns run in different directions as above are superior.

If a piece made from a warp-knitted fabric provided with a Jacquard pattern is subjected to Jacquard control (on a warp-knitting machine having a Jacquard control mechanism), then it is possible to change the knitting structure partially to a structure that differs from the base knitting structure. For the Jacquard pattern, it is suitable to use a small pattern, and even though there are no particular limitations, examples that can be given include floral patterns, such as a flower pattern, or other decorative patterns. There is no particular limitation with regard to size, but a small pattern in which the length of the portions with maximum length is not more than 10 cm, more preferably not more than 5 cm is preferable.

The above-described 1×1 tricot structure, half structure, atlas structure etc. forming the piece having an edge that does not require hem finishing when left as cut can be knitted on a tricot machine or a Raschel machine. If additionally a Jacquard pattern is applied as explained above, then a machine should be used that is equipped with a Jacquard control mechanism.

If the warp-knitted fabrics with these knitting structures are cut parallel to the knitting direction, then fraying or curling may occur, but if they are cut at an angle of at least 3° and at most 177° with respect to the knitting direction, and the cut end is used as an edge portion of the garment, then the garment edge portion can fit on the body without fraying or curling even when the edge portion is left as cut.

Figure 10:
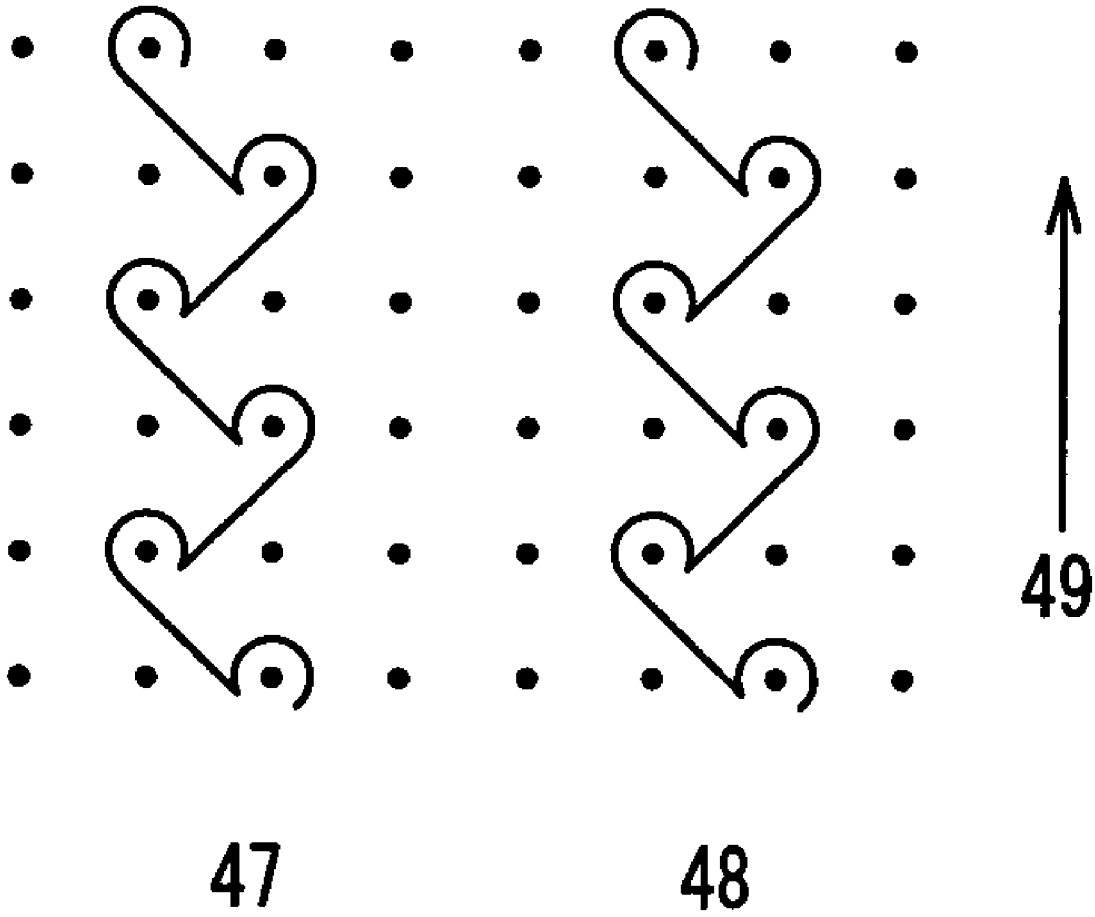
FIG. 10 shows a knitting structure diagram of a stretchable warp-knitted fabric used in the present invention.
Figure 11:
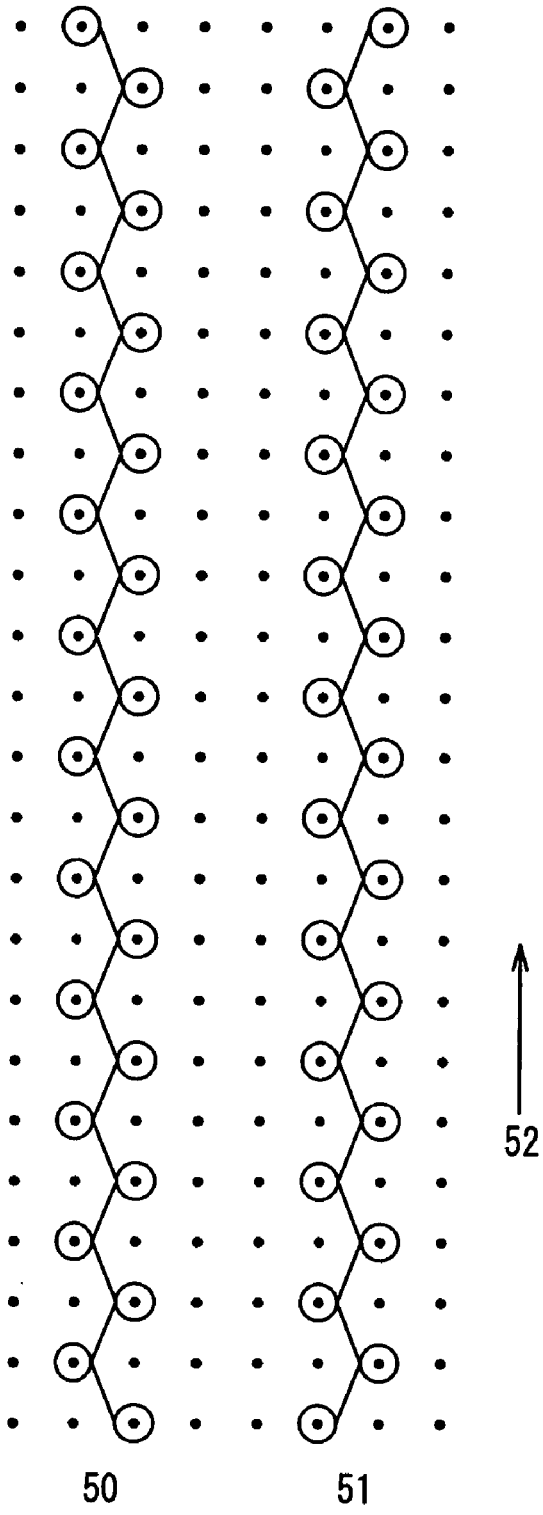
FIG. 11 shows a knitting structure diagram of a stretchable warp-knitted fabric used in the present invention.

Of the above-described stretchable warp-knitted fabrics, the following stretchable warp-knitted fabrics are superior in practice: A stretchable warp-knitted fabric as shown in FIG. 10, in which a non-elastic yarn 47 and an elastic yarn 48 run in the same direction and have a 1×1 tricot structure, and both the non-elastic yarn 47 and the elastic yarn 48 are knitted with open loops. The direction of arrow 49 is the knitting direction of the knitted fabric. A stretchable warp-knitted fabric as shown in FIG. 11, in which a non-elastic yarn 50 and an elastic yarn 51 run in different directions and have a 1×1 tricot structure, and both the non-elastic yarn 50 and the elastic yarn 51 are knitted with closed loops. The direction of arrow 52 is the knitting direction of the knitted fabric. Although it is not shown in the drawings, also a stretchable warp-knitted fabric in which a non-elastic yarn and an elastic yarn run in different directions, and that is knitted such that either the non-elastic yarn or the elastic yarn forms closed loops, for example the non-elastic yarn forming closed loops and the elastic yarn forming open loops, or the non-elastic yarn forming open loops and the elastic yarn forming closed loops, is also superior in practice.

Figure 12:
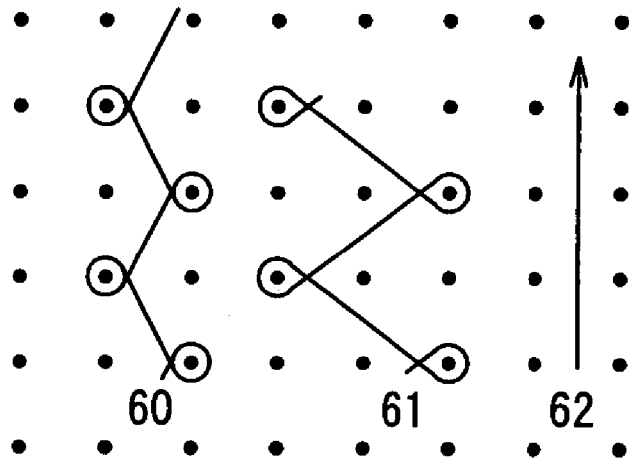
FIG. 12 shows a knitting structure diagram of a stretchable warp-knitted fabric used in the present invention.
Figure 13:
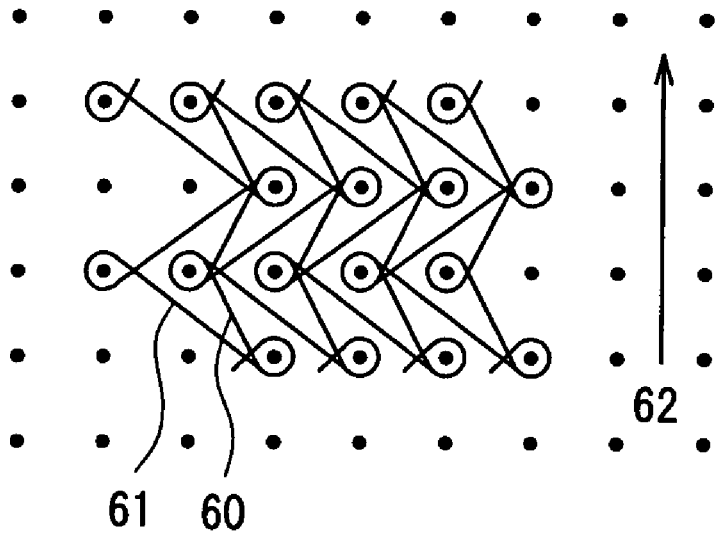
FIG. 13 is a knitting structure diagram showing the non-elastic yarn 60 and the elastic yarn 61 shown in FIG. 12 superimposed upon one another.

Moreover, the knitting structure shown in FIG. 12 is a stretchable warp-knitted fabric in which a non-elastic yarn 60 is arranged in a 1×1 tricot structure and an elastic yarn 61 is arranged in a half structure, and both are knitted with closed loops. FIG. 13 is a knitting structure diagram showing the non-elastic yarn 60 and the elastic yarn 61 shown in FIG. 12 superimposed upon one another. The direction of arrow 62 is the knitting direction of the knitted fabric. As noted above, this structure is a particularly advantageous knitting structure when a cotton yarn is used for the non-elastic yarn 60. It is also possible to use a stretchable warp-knitted fabric, in which either the non-elastic yarn or the elastic yarn is knitted with closed loops, for example the non-elastic yarn is knitted with closed loops and the elastic yarn is knitted with open loops, or the non-elastic yarn is knitted with open loops and the elastic yarn is knitted with closed loops.

Figure 14:
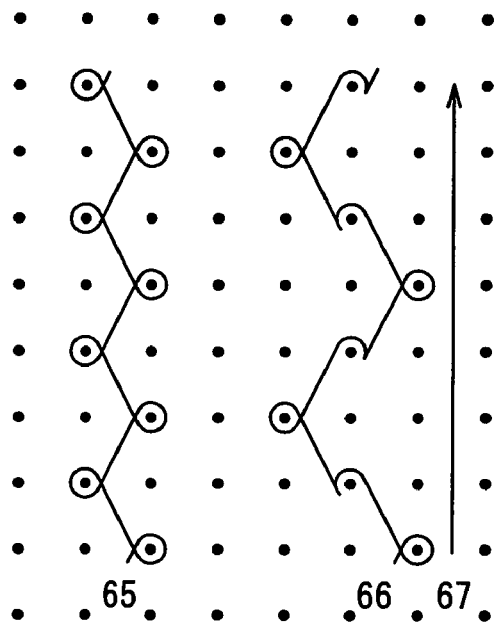
FIG. 14 shows a knitting structure diagram of a stretchable warp-knitted fabric used for the present invention.
Figure 15:
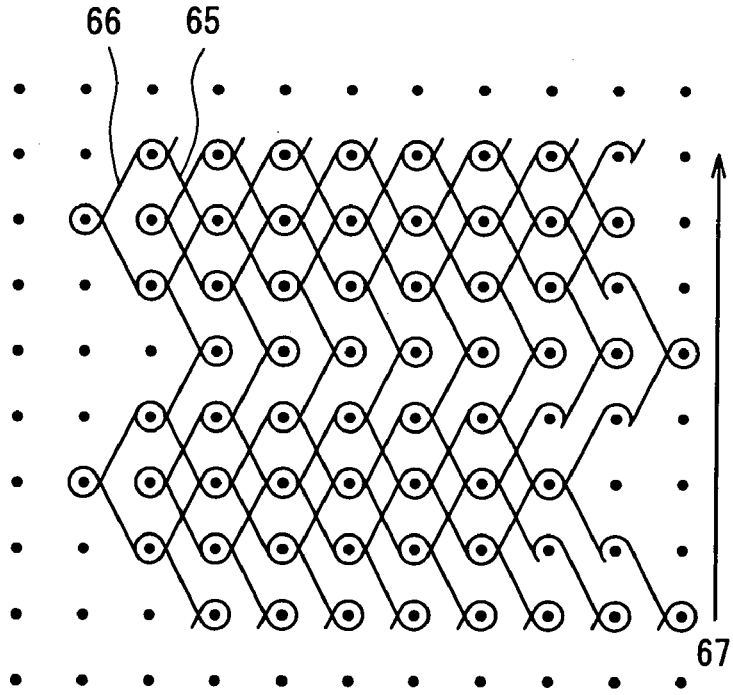
FIG. 15 is a knitting structure diagram showing the non-elastic yarn 65 and the elastic yarn 66 of FIG. 14 superimposed upon one another.

The knitting structure shown in FIG. 14 is an example in which a non-elastic yarn 65 is arranged in a 1×1 tricot structure and an elastic yarn 66 is arranged in an atlas structure (in this case, four-course atlas), and the non-elastic yarn 65 is knitted with closed loops. FIG. 15 is a knitting structure diagram showing the non-elastic yarn 65 and the elastic yarn 66 of FIG. 14 superimposed upon one another. The direction of arrow 67 is the knitting direction of the knitted fabric.

The pieces described above can also be used as laminates that are laminated in two or more layers and bonded together with a resin adhesive or the like, as necessary. If a plurality of knitting fabrics are laminated together and used as the piece, then it is ordinarily sufficient to laminate two knitted fabrics together, but if necessary, it is also possible to laminate three or more together. If used as the material for a back cloth of a brassiere or the back cloth in the top of a two-piece bathing suit or a leotard, then it is preferable that a piece is used that is made by laminating together a plurality of knitted fabrics in this manner.

For example the following can be given as examples of combinations of fabrics that can be laminated and by bonding them together like this:

(1) A piece that is laminated by bonding at least one material selected from a group (A) consisting of (A-1) and (A-2) listed below to a material made of a cloth other than (A-1) and (A-2), where (A-1) is a warp-knitted fabric wherein both the non-elastic yarn and the elastic yarn are arranged in a 1×1 tricot structure and run in the same direction, and both the elastic yarn and the non-elastic yarn form closed loops; and where (A-2) is a warp-knitted fabric wherein both the non-elastic yarn and the elastic yarn are arranged in a 1×1 tricot structure and run in the same direction, and one of the elastic yarn and the non-elastic yarn forms closed loops and the other one forms open loops.

Thus, if a laminated piece including at least the material (A-1) or (A-2) is used to form the back cloth of a brassiere or the like, fraying does not occur when an edge portion that is left as cut is used as the edge portion of a garment (back cloth or the like) without hem finishing.

On the other hand, by laminating (A-1) or (A-2) with a material other than (A-1) or (A-2), it is possible to attain characteristics that are difficult to realize with the materials (A-1) and (A-2).

In this case, ordinarily, a knitted fabric with another knitting structure should be used as the material made from the other cloth, and it is preferable that it is at least one material selected from a group (B) consisting of (B-1) to (B-4), where (B-1) is a warp-knitted fabric in which the non-elastic yarn is arranged in a 1×1 tricot structure and the elastic yarn is arranged in a half structure;

(B-2) is a warp-knitted fabric in which the non-elastic yarn is arranged in a 1×1 tricot structure and the elastic yarn is arranged in an atlas structure;

(B-3) is a warp-knitted fabric wherein both the non-elastic yarn and the elastic yarn are arranged in a 1×1 tricot structure and run in the same direction, and both the non-elastic yarn and the elastic yarn form open loops; and (B-4) is a warp-knitted fabric wherein the non-elastic yarn and the elastic yarn run in different directions, and both the non-elastic yarn and the elastic yarn are arranged in a 1×1 tricot structure and form closed loops.

An other example of such materials other than (B-1) to (B-4) is a tricot material in which both the non-elastic yarn and the elastic yarn are arranged in a half structure. If used for a garment edge portion without hem finishing the cut edges of the material, then it is preferable that the laminated material is a tricot material in which all the knitting yarns are formed to loopings.

(2) It is also possible to use a piece that is laminated by bonding together a plurality of materials of at least one type selected from the group of (B-1) to (B-4), where (B-1) is a warp-knitted fabric in which the non-elastic yarn is arranged in a 1×1 tricot structure and the elastic yarn is arranged in a half structure;

(B-2) is a warp-knitted fabric in which the non-elastic yarn is arranged in a 1×1 tricot structure and the elastic yarn is arranged in an atlas structure;

(B-3) is a warp-knitted fabric wherein both the non-elastic yarn and the elastic yarn are arranged in a 1×1 tricot structure and run in the same direction, and both the non-elastic yarn and the elastic yarn form open loops;

(B-4) is a warp-knitted fabric wherein the non-elastic yarn and the elastic yarn run in different directions, and both the non-elastic yarn and the elastic yarn are arranged in a 1×1 tricot structure and form closed loops.

Of these, of the combinations listed under (1), it is even more preferable that the material (A) is (A-1) and the material (B) is (B-1). If a cotton yarn is used for the non-elastic yarn in this combination, then fraying of the edges left as cut can be favorably prevented, which is even more preferable.

Furthermore, if the combination (A-1) and (B-1) is used, then it is preferable that a cotton yarn is used for the non-elastic yarn of (B-1) and both the non-elastic yarn and the elastic yarn of (B-1) form closed loops, because this way fraying of the edges that are left as cut can be prevented favorably. Furthermore, if this laminated piece is used, then a design in which (B-1) is on the skin side is most preferable with regard to touch to the skin and sweat absorption.

Moreover, if a laminated piece is formed from a piece having a Jacquard pattern as described above and a piece not having a Jacquard pattern, then it is preferable that the piece having the Jacquard pattern is arranged on the outer side of the garment.

Moreover, if a laminated piece is formed from a piece having a Jacquard pattern as described above and a piece not having a Jacquard pattern, then it is preferable that in particular the above-described (A-1) or (A-2) is used as the material for the piece without the Jacquard pattern. With this combination, it is possible to prevent fraying also when using an edge portion (of for example the back cloth of a brassiere) that is left as cut as an edge portion of the garment without hem finishing.

Moreover, with regard to improving the design, it is preferable that the other laminated knitted fabric is a material into which a decorative pattern, such as a flower pattern, has been knitted by Jacquard control. If the material (A-1) or (A-2) is arranged on the skin side and the material into which the Jacquard pattern has been knitted is arranged on the outer side, then fraying does not occur, and a garment with superior design can be obtained, which is preferable.

When fabricating the laminated piece, it is possible to first laminate a plurality of pieces layered on top of each other, bond them together and then cut them to the desired shape, or to cut the individual pieces to a predetermined shape, and then laminate them by layering the plurality of pieces and bonding them together.

In either case, a piece results in which of a plurality of pieces of the same shape are bonded together, becoming one fabric in practice. Thus, there is no level difference in the piece. Also, because knitted fabrics in which no fraying in any single one of them occurs are bonded together, there is no disentangling of the edge portions of the piece or protrusion of yarn ends, and the edge portions are neat. Needless to say, it is also possible to increase the tear strength.

"Formed by laminating by bonding a plurality of pieces together" means layering two or more pieces on top of each other and laminating them by bonding them together such that they cannot be easily peeled apart. There is no particular limitation regarding the bonding means, and an adhesive such as a thermobonding resin can be used. Point adhesion in which the adhesive is applied at a multitude of points is preferable with regard to air permeability.

The non-elastic yarn that is used depends on the type of the stretchable fabric. It is possible to use a synthetic fiber such as nylon or polyester, a semi-synthetic fiber such as rayon, or a natural fiber such as silk or cotton, and it is possible to use a filament yarn or a spun yarn. Of these, nylon yarn, which has excellent water absorption, is preferably used in knitted fabrics for inner wear. There is also no particular restriction with regard to the elastic yarn, and generally it is possible to use uncovered polyurethane elastic yarn or yarn in which such elastic yarn has been covered with a non-elastic yarn (covered yarn). With uncovered yarn, the knitting density can be easily increased. Moreover, cotton has superior skin touch and is also preferable with regard to sweat absorption.

With non-elastic yarn, the density of the knitting loops can be increased more easily with finer yarns. On the other hand, when the yarn is too fine, then its strength becomes too weak. Thus, 33 to 154 dtex is preferable, because the knitted fabric can be easily made with high density, and a knitting structure that is stable and strong can be achieved. If the non-elastic fabric is more preferably 33 to 88 dtex, even more preferably 33 to 77 dtex or yet even more preferably 33 to 55 dtex, then a knitted fabric with high density is possible, and a knitting structure that is stable and strong can be achieved, which is preferable. If cotton yarn is used, then it is preferable that it can be knitted with a high knitting density, in order to ensure that there is no fraying at the edge portions that are left as cut, and consequently it is preferable that a relatively fine cotton yarn is used, because this way the knitting density can be increased easily. In this case, it is preferable to use a cotton yarn with a yarn number that is finer than 50 more, preferably a cotton yarn with a yarn number that is finer than 70 as the cotton yarn. Ordinarily, a yarn that is as fine as possible is preferable, but at present, the finest cotton yarn that is commercially available has a yarn number of about 100. Consequently, if cotton yarn is used, a cotton yarn with a yarn number of 50 to 100 is preferable.

As for the elastic yarn, fabrics with higher densities can be made with finer yarns. When the yarn is 154 dtex or more, then it is possible to achieve a knitted fabric having an edge that does not require hem finishing when left as cut, but the stretchability becomes small, so that it is preferable to use a fabric with not more than 154 dtex for garments worn closely to the body. More preferable is 15 to 100 dtex, and even more preferable is 33 to 88 dtex. On the other hand, it is possible to use an elastic yarn that is thicker than 154 dtex for garment portions for which no stretchability is required. Moreover, even with elastic yarns of more than 231 and up to 396 dtex, it is possible to obtain a knitted fabric having edge portions that are left as cut and do not tend to fray, if the elastic yarn is relatively soft. The extensibility is small, but they can be used for portions for which no extensibility is required.

Moreover, as these stretchable warp-knitted fabrics, fabrics are suitable that have been subjected to a presetting process and/or a heat-setting process, for the purpose of attaining stability of the knitting loops and the effect of preventing fraying of edges that are left as cut. The process temperature depends on the shape of the device, the presetting process time, the heat-setting process time, the type of material, and the thickness of the knitted fabric, but it is preferable that this process is performed at a temperature of at least 180°, preferably at least 185° or in a range of 190° C. to 195° C. in order to reliably attain the aforementioned effects, because in this case a portion of the fabric is softened, and the loops become slightly fused, thus stabilizing the fabric, and the edges that are left as cut become particularly resistant against fraying. If a device with a 6 to 8 chamber configuration (total length of the chambers: about 15 to 30 m) is used, then the heat-setting process time may be about 15 to 40 m/min, and preferably about 15 to 24 m/min.

Furthermore, in ordinary knitted fabrics, the finished width is set to about 160 cm, but in the stretchable warp-knitted fabrics of the present invention, the finished width is set shorter than that to 100 to 140 cm, more specifically to 110 cm, 120 cm or 130 cm, for example, and it is desirable that the fabric is knitted to a high density within the possible range in order to increase stability, while maintaining the attractiveness of the knitting loops in the stretchable garment. Although it also depends on the denier of the knitting yarn that is used, it is preferable that the knitted fabric is knitted at a high density of more than 55 wales, more preferably more than 60 wales, even more preferably more than 65 wales and most preferably at least 70 wales per 2.54 cm (1 inch), and that the proportion of lateral extensibility of the knitted fabric is large. However, this is not necessarily required when a cellulose yarn or cotton yarn is used as the non-elastic yarn.

Furthermore, a stretchable warp-knitted fabric is preferably used, in which the used amount of non-elastic yarn is increased and longer, and the elastic yarn is shorter than in the ordinary case, and the runner length of the non-elastic yarn is much longer than runner length of the elastic yarn. More specifically, it is preferable that the runner of a non-elastic yarn of an ordinary 80 cm/rack or less is set to 85 to 120 cm/rack, more preferably 95 to 115 cm/rack, and the runner of an elastic yarn of an ordinary 60 cm/rack or less is set to 70 to 110 cm/rack, more preferably 75 to 105 cm/rack.

It should be noted that here, "runner" means the length (in cm) of the yarn that is used to knit a predetermined number of courses (this is called "rack"; normally, 480 courses constitute one rack).

The ratio (A/B) of the runner A of the non-elastic yarn to the runner B of the elastic yarn is preferably at least 1.15, more preferably at least 1.2, and most preferably at least 1.3.

It should be noted that the warp-knitted fabrics according to the present invention that can be provided with edges that do not require hem finishing when left as cut are not lace fabrics.

Moreover, if, of the edges of the piece made of the stretchable warp-knitted fabric that do not require hem finishing when left as cut, at least one of the upper edge and the lower edge in the garment is an edge that does not require hem finishing, then fraying and curling of this edge can be prevented if it is cut at an angle that is not parallel to the knitting direction within a range of at least 3° to 177° with respect to the knitting direction of the knitted fabric. It is furthermore preferable that the edge is cut at an angle of 5° to 150°, more preferably 10° to 120°, even more preferably 15° to 90°, yet even more preferably 20° to 80°, more preferably 30° to 60°, even more preferably 40° to 50°, and most preferably 45° or thereabout (more specifically 43° to 47°).

The angle that is meant here by the "cutting angle of the edge" is explained with reference to the diagram in FIG. 16.

Figure 16:
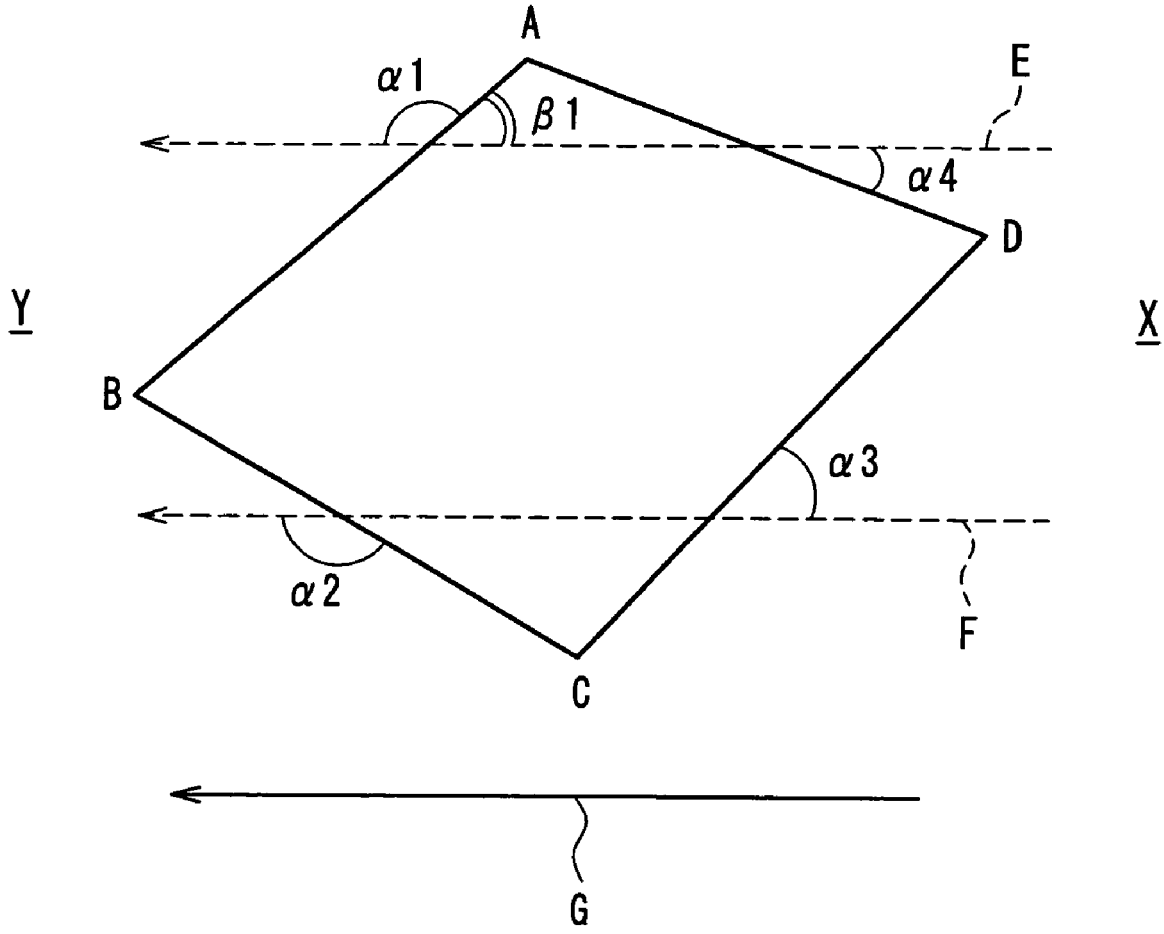
FIG. 16 is a schematic diagram illustrating the cutting angles of the edges.

In FIG. 16, the portion enclosed by A-B-C-D-A is the cut piece. The arrows E, F and G indicate the knitting direction of this fabric. The side X in FIG. 16 is the "knitting start side" and the side Y in FIG. 16 is the "knitting end side." Consequently, the edge A-D and the edge C-D are edges on the knitting start side, whereas the edge A-B and the edge B-C are edges on the knitting end side.

In the case of the edges on the "knitting start side" (A-D and C-D), the cutting angle of the edges refers to the acute angle (a4 or a3) of the angles defined by the edge line and the knitting direction. In the case of the edges on the "knitting end side" (A-B and B-C), the cutting angles of the edges refers to the obtuse angle ($\alpha$1 or $\alpha$2) of the angles defined by the edge line and the knitting direction.

The foregoing is the formal definition of the cutting angle of the edges in the present invention, but for the sake of convenience, the cutting angle of, for example, the edge A-B in FIG. 16 may also be described using the angle $\beta$1, and it can be easily seen that then the cutting angle of the edge A-B is "180-$\beta$1" degree, as is evident from the above definition of the cutting angle of the edge.

It is preferable that the cutting angles of the edge lines in the embodiments of the present invention are set as noted above, because this improves the body-fit of the edges that do not require hem finishing when left as cut, and prevents curling of the edge portions away from the wearer's body. That is to say, in garments having edges that do not require hem finishing when left as cut at the upper edge or lower edge of the garment, for example the waist or the bottom, it occurs that these edge portions curl away from the wearer's body. In order to ensure that such curling does not occur, it is preferable that the cutting line of the portions serving as the edges that do not require hem finishing are cut at the above-noted angles with respect to the knitting direction of the knitted fabric. The knitting direction of the knitted fabric corresponds to the direction in which the yarn is supplied when knitting the fabric. In the above, an angle of 20° to 80° with respect to the knitting direction means that there is an angle of 20° to 80° to either the left or the right side of the line of the knitting direction, or in other words, the angle in which the vertex side of the angle points in the direction in which the knitting direction advances, or an angle of ±20° to 80° with respect to the line in the direction in which the knitting direction advances.

It should be noted that if the edges that do not require hem finishing when left as cut are used at parts for which there is little necessity to prevent curling away from the body, then it may be preferable that a piece is used that has edges that are cut at an angular range not exceeding 45°. Furthermore, it is preferable that a piece is used whose edges are cut not to straight lines but to wave-shaped lines, because then it can be prevented that the edge portions curl away from the body.

When cutting a piece of garment, if a plurality of edge portions serve as edges that do not require hem finishing when left as cut, then there may be locations that cannot be cut at, for example, the preferable range of 20° to 80° within the range of 3° to 177° with respect to the knitting direction, and that must be cut at an angle of less than 20° to the knitting direction. If such edge portions are cut to a wave shape, then the cutting angle of the edge portions serving as the curves in the wave shape can be set to for example the preferable range of 20° to 80°, and the same effect can be attained as when the entire edge portion is cut to substantially 20° to 80°. In cases in which both the waist line and the bottom line of a short girdle are edges not requiring hem finishing when left as cut, using one piece that is continuous in the vertical direction of the garment, it may occur that it is not possible to cut both edge portions at an angle of, for example, 20° to 80° with respect to the knitting direction, due to the design of the garment, and in such cases it is preferable that one edge is cut to a wave-shaped edge.

In particular in bottom garments such as girdles or short panties, using an edge portion of a piece that is cut at the above-noted angles for the waist or the bottom line can prevent fraying or curling of the edge portion.

In the case of brassieres or tops of bathing suits or leotards, when the piece of the back cloth is cut at an angle that is close to parallel or perpendicular, for example ±20° with respect to perpendicular or parallel to the knitting direction, then it is possible to provide stretchability in the lateral direction when wearing the back cloth, which is preferable because it improves the wearing comfort. Often, the back cloth is substantially trapezoidal, and its width becomes narrow from the cup sides towards a rear central linking portion referred to as "hook and eye", with the upper edge and the lower edge corresponding to the two oblique sides of an isosceles triangle. Thus, one of the upper edge and the lower edge of the back cloth is preferably cut at an angle of 10° to 90°, more preferably 75° to 90° with respect to the knitting direction. When the cutting angle of the one edge portion is a degree, then the other edge portion is cut at an angle that is close to the angle (180°-$\alpha$) degree. If cut at an angle that is close to a right angle, then the lower edge of the back portion is cut at 100° and the upper edge is cut at 80°, for example. If cut at an angle that is close to parallel to the knitting direction, then the upper edge of the back cloth is cut at 15° and the lower edge is cut at 165°. In this manner, even when the piece of the back cloth is cut at an angle that is outside the angles close to parallel or perpendicular with respect to the knitting direction, if the cutting shape is a wave shape with a plurality of curves, then fraying or curling of the edge portion does not occur, and there is a certain degree of stretchability, so that it is permissible. "Wave shape with a plurality of curves" means not a simple convex or concave curve that is curved to one side, but a curve that is formed by a combination of a plurality of convex and concave curves, such as a curve with convex and concave wave lines. "Wave shape with a plurality of curves" thus means a curve that is "wave-shaped." The wave shape is not limited to waves in which a regular simple curve is repeated, and may also be an irregular wave shape. If the shape of the curved edges that are left as cut is wave-shaped, then it is preferable that the curvature of the curves of the wave shape is not too small, because then the tear strength is not decreased, and there is no turning (curling) of the edge portion.

In the case of the back cloth of a brassiere or the top of a bathing suit or leotard, two knitted fabrics may be laminated by bonding them together in order to increase the strength. In this case, the two knitted fabrics may be cut to the desired shape after they have been bonded and laminated, or they may be bonded and laminated after two pieces of knitted fabrics have been cut to the same shape. In either case, the two pieces of the same shape are laminated together by bonding, and become substantially one piece. Thus, there are no level differences in the back cloth. Also, because knitted fabrics in which no fraying occurs are bonded together, there is no disentangling of the edge portions of the piece or protrusion of yarn ends, and the edge portions are neat.

As described above, for the "back cloth formed by laminating by bonding two pieces of the same shape together," the pieces may be cut to the same shape before laminating them together, or they may be cut to predetermined shape after bonding and laminating the knitted fabrics.

A preferable embodiment for the laminated piece for the case that the laminated piece is used for the back cloth of a brassiere or the like is similar to the laminated piece described above.

It should be noted that if the line of the edge portion is wave-shaped, then the cutting angle means the angle between the knitting direction and a virtual straight line leveling the concave and convex portions of the wave shape of the cut edge portion. The virtual straight line leveling the concave and convex portions of the wave shape of the cut edge portion may be the tangent line connecting the vertices of a scallop-shaped wave of an edge not requiring hem finishing, or the center line bisecting the wave into upper half and lower half. If there are a plurality of irregular wave shapes, and the virtual straight line is unclear, then the cutting angle is the angle between the knitting direction and the straight line connecting both ends in the longitudinal direction of the edge line of the edge portion of the piece cut from the knitted fabric or the garment using the same. If one curve appears in the edge portion, then the cutting angle means the angle between the knitting direction and the straight line connecting both ends in the longitudinal direction of the curve. A scallop-shaped portion of an edge not requiring hem finishing is a wave-shaped curve, but the line of the overall edge corresponding to the forward direction of this wave can be expressed by a virtual straight line. This is the same treatment as with that light which undulates, but whose forward direction is drawn overall as a straight line.

Moreover, in the piece according to the present invention, shape of the edge portion can be formed as one arc-shaped curve or as a wave shape with a plurality of curves, and by cutting the edge portion to a curve or a wave shape, it is possible to prevent fraying or curling. In the case of bottom garments such as girdles or short panties, making the waist line a curve that concavely sags downwards prevents curling and allows fitting to the waist. Making the bottom line of short girdles or short panties a curve that convexly protrudes downward on the whole prevents curling and allows fitting to the hip line. Alternatively, making the bottom line wave-shaped prevents curling and allows fitting to the hip line. Alternatively, it is preferable to make the overall bottom line (macroscopically) a curve that protrudes convexly downward, and to make it microscopically wave-shaped. If the piece contacting the hip or the side of the abdomen portion is a continuous piece ("continuous piece" means a piece that is not made by patching together a plurality of parts, but made of one part that is continuous in the planar direction), then the shape of the edge portion line may also be changed, with the line contacting the hip bottom and the edge portion line contacting the side of the abdomen portion. For example, the hip bottom line may be curved protruding convexly downward or wave-shaped, or it may be overall curved protruding convexly downward in addition to being wave-shaped, and then the bottom line of the edge portion contacting the side of the abdomen portion may also be a curve protruding convexly upward.

In order to ensure that the upper and the lower edge portion of the piece can fit the body portions that they contact, it is preferable that the shape of the upper edge is different from the shape of the lower edge, or that the upper edge and the lower edger are non-parallel, or that the shape of the upper edge and the lower edge are different and the upper edge and the lower edge are non-parallel, because this way, the garment can be fitted against the three-dimensional shape of the body.

Moreover, in the present invention, it is preferable that the fabric that can be formed with an edge that does not require hem finishing when left as cut is partially provided with a straight boundary line at which the stretching power changes due to the elastic yarn, because this way the body-shaping function is improved. "Straight boundary line at which the stretching power changes" means that a region of strong stretching power and a region of weak stretching power are formed such that the border between the region of strong stretching power and the region of weak stretching power is straight line (this encompasses the case that the region of strong stretching power and the region of weak stretching power include regions with two or more grades of different stretching powers; moreover, the stretching power may change continuously).

To partially provide a straight boundary line at which the stretching power changes due to the elastic yarn, the following approaches are suitable:

(a) A method of forming a plurality of regions of different stretching powers by forming a plurality of regions with different thicknesses of the elastic yarn that is knitted in;

(b) A method of forming a plurality of regions of different stretching powers by forming a plurality of regions with different numbers of elastic yarns that are knitted in;

(c) A method of forming a plurality of regions of different stretching powers by combining (a) and (b) as appropriate.

It should be noted that it is also possible to form a plurality of regions with different stretching power in which the borders of the plurality of regions are linear, by knitting in or inserting a second non-elastic yarn.

Here, "strong stretching power" means that the straining force is high and the stretchability is low.

It is also possible to use, for a part of the garment, a fabric provided with an edge that does not require hem finishing made by pulling out yarn by the conventional method, or a fabric not requiring hem finishing (in the following, this is referred to shortly as "fabric different from the present invention".)

It is preferable that all or almost all portions of the edge portion of the garment are provided with a flat surface and that no hem finishing by sewing is performed, but in order to strengthen portions where there tends to be tension when wearing the garment, it is also possible to provide a seam of about 0.5 to 2 cm length at these edge portions. Examples of such locations are the portion of the back cloth next to the cup wire at the upper edge of the back cloth of a brassiere, the back edge portion next to a rear central linking portion referred to as "hook and eye" in the rear center, or the vicinity of the seam of the crotch cloth of a short girdle or short panty.

The present invention is effective in garments that fit the body closely. Examples of garments to which the present invention can be applied preferably are short girdles, long girdles, short panties, spats, brassieres, bathing suits, leotards, body slips, body camisoles, body suits and body teddies.

EXAMPLE 1

Figure 2:
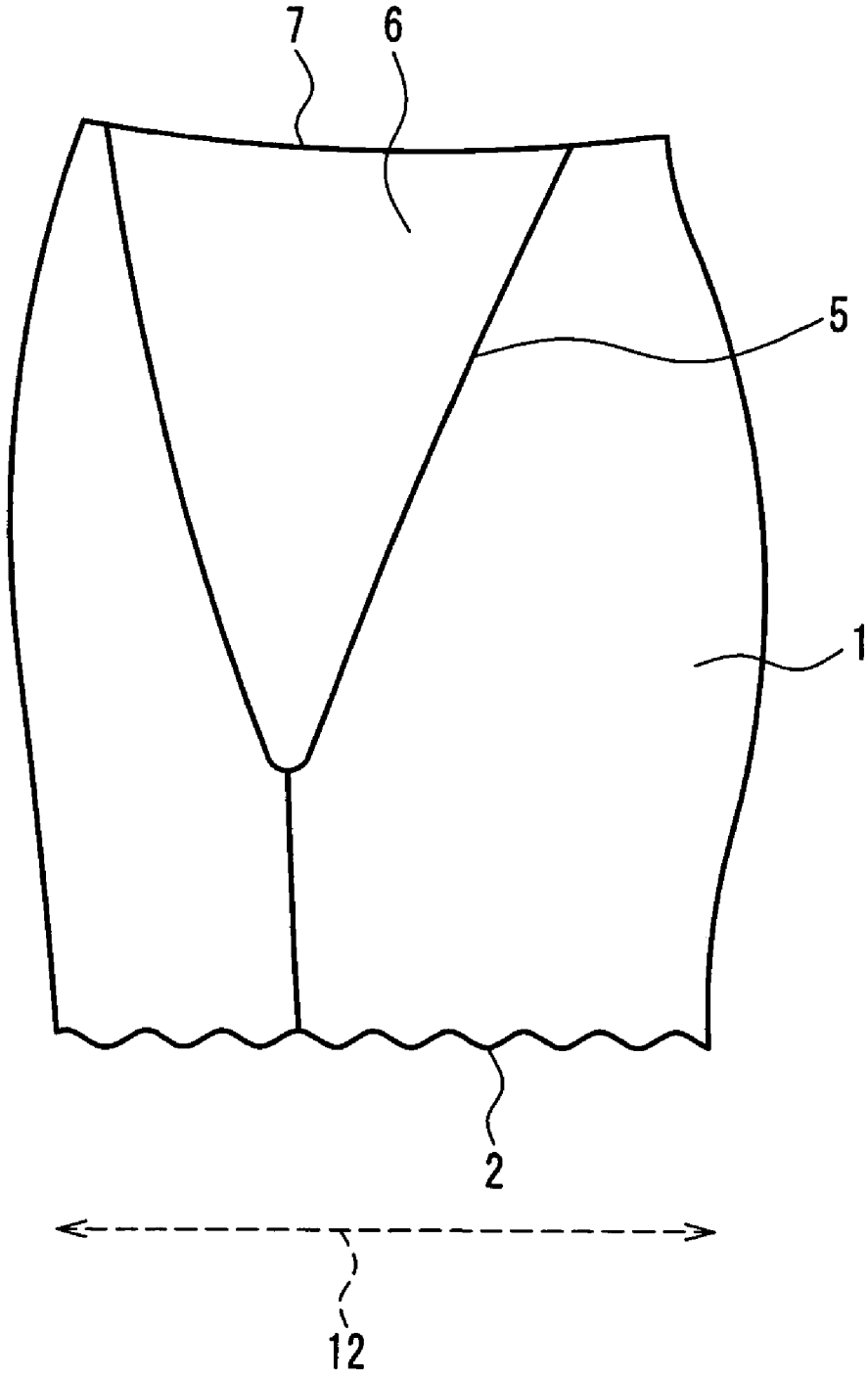
FIG. 2 is a perspective view showing the semi-long girdle of FIG. 1, seen from the front side.
Figure 3:
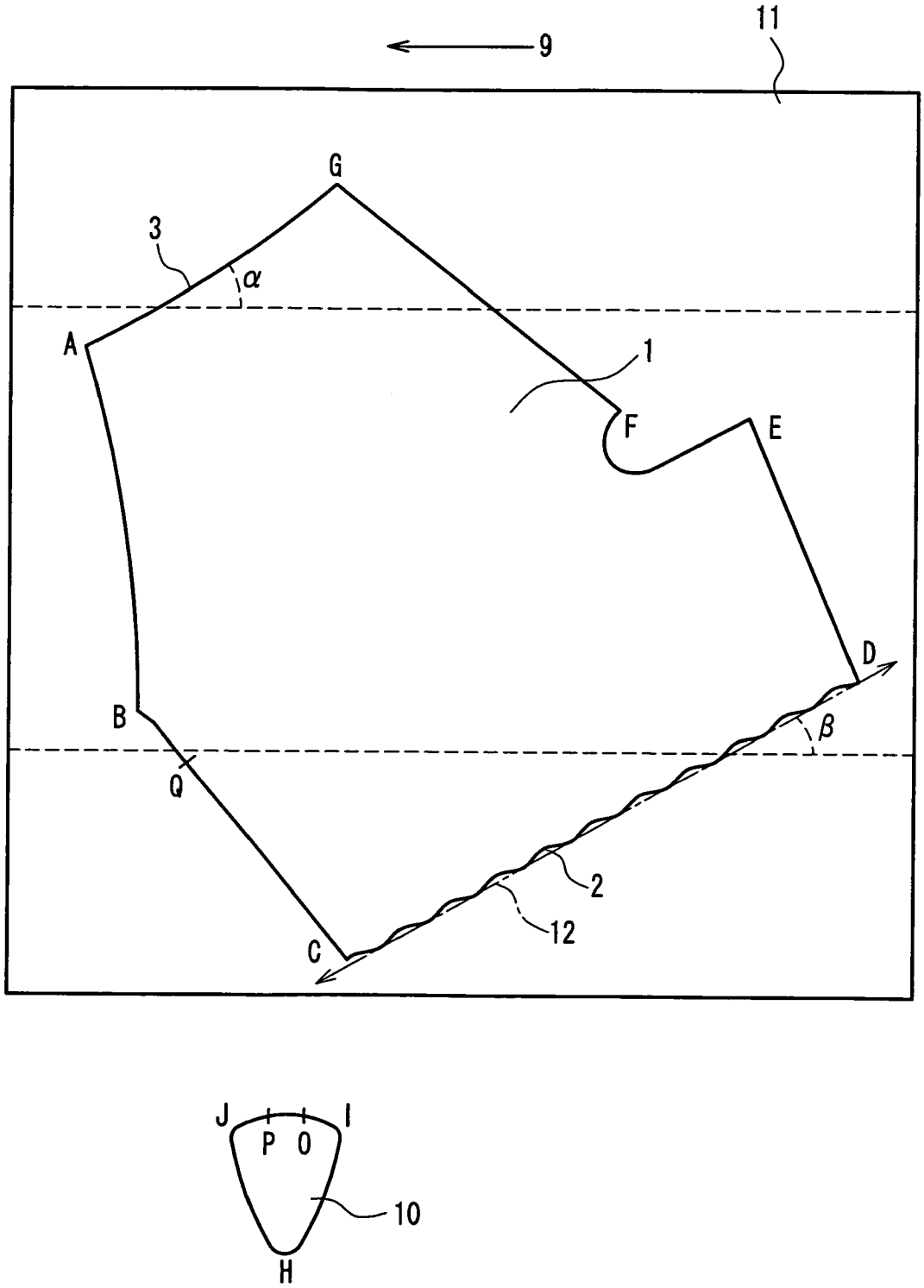
FIG. 3 is a plane view showing, on a knitted fabric, a cutting line of a side front—side—hip portion—leg portion covering piece 1, corresponding to the left side of the wearer of the semi-long girdle shown in FIG. 1 and FIG. 2, as well as a plane view of a crotch piece.

FIG. 1 is a perspective view showing a semi-long girdle according to an embodiment of the present invention of a garment that has an edge that does not require hem finishing when left as cut and that has a body-shaping function, seen from the rear side. FIG. 2 is a perspective view of the semi-long girdle of FIG. 1, seen from the front side. FIG. 3 is a plane view showing, on a knitted fabric, a cutting line of a side front—side—hip portion—leg portion covering piece 1, corresponding to the left side of the wearer of the semi-long girdle shown in FIG. 2, as well as a plane view of a crotch portion.

In FIGS. 1 to 3, reference numeral 1 denotes the side front—side—hip portion—leg portion covering piece covering the side front—side—hip portion—leg portion, which is continuous in vertical direction of the girdle and made of one piece without a level difference in its surface. Reference numeral 6 denotes an abdomen portion covering piece covering the abdomen, which is continuous in the vertical direction of the girdle and made of one piece without a level difference in its surface. The side front—side—hip portion—leg portion covering pieces 1 on the left and right are sewn together by a rear center seam line 4, but not at the leg portion, and the side edges to the front of the side front—side—hip portion—leg portion covering pieces 1 are sewn to the side edges of the abdomen portion covering piece 6 at a seam line 5. In the perspective drawing of FIG. 1, which is taken from the rear side, it is difficult to understand from where the leg portions start, so that a virtual dotted line 8 has been added to the figure, to indicate that roughly the region below the virtual dotted line 8 corresponds to the leg portions. Consequently, the seam line 4 above the virtual dotted line 8 is the rear center seam line, and leg portions are formed by dividing the region below the virtual dotted line 8 into left and right leg.

The line A-B-C-D-E-F-G-A shown on the fabric 11 in FIG. 3 indicates the cutting line of the side front—side—hip portion—leg portion covering piece 1 for obtaining the piece of the half on the left side of the wearer, which is used for the portion from the side of the girdle rearward and for the leg portions. Moreover, reference numeral 10 denotes a crotch piece, which may be made of the same fabric or a different fabric as the side front—side—hip portion—leg portion covering piece 1. For the material of the crotch piece, various kinds of materials that are conventionally used for girdle crotch pieces can be used. The crotch piece 10 forms the crotch portion, and is not shown in FIGS. 1 and 2.

Although it is not shown in the drawings, the shape of the side front—side—hip portion—leg portion covering piece 1 for the right half is the mirror symmetric shape of the portion for the left half. The line A-B is sewn to the abdomen portion covering piece 6 in FIG. 1, the line Q-C is sewn to the line E-D, thus forming the left leg portion, and the line G-F is sewn to the corresponding portion of the afore-mentioned piece of the right half (not shown in the drawings), forming the rear center seam line 4. The line P-O of the crotch piece 10 is sewn to the lower edge of the abdomen portion covering piece 6, the line O-I of the crotch piece 10 is sewn to the line B-Q of the piece 1, and the line H-I of the crotch piece 10 is sewn to the line F-E of the piece 1. The sewing for the piece 1 of the right half, which is not shown in the drawings, is similar, because it is left-right symmetric. In this manner, the girdle shown in FIGS. 1 and 2 can be fabricated. Also the girdles of the other embodiments are formed by sewing in substantially the same manner.

In the girdle shown in FIGS. 1 to 3, a piece whose edge portions do not require hem finishing when left as cut is used as the side front—side—hip portion—leg portion covering piece 1.

The knitting direction of the warp-knitted fabric constituting the side front—side—hip portion—leg portion covering piece 1 is indicated by the arrow direction of arrow 9.

The side front—side—hip portion—leg portion covering piece 1 has a 1×1 knitted structure in which a nylon yarn and a polyurethane yarn run in different directions as shown in FIG. 11, and is knitted such that both the elastic yarn and the non-elastic yarn form closed loops. It is knitted from a 44 dtex nylon yarn and 77 dtex polyurethane yarn, at a knitting density of 70 wales per inch (2.54 cm).

In the present embodiment, the edge of the side front—side—hip portion—leg portion covering piece 1, which does not require hem finishing when left as cut, forms an edge of a bottom line 2 and an edge of a waist line 3. The bottom line 2 is wave-shaped, and the direction of the bottom line 2 is the same direction as the straight line connecting the crests of this wave shape, that is, the direction indicated by arrow 12 (see FIG. 3). The bottom line is cut at an angle β of about 30° with respect to the knitting direction. Overall, it is cut at about 30°, but the overall bottom line is cut to a plurality of wave shapes, and portions of the wave shapes are cut at angles exceeding 30°.

The waist line 3 is cut to a curved line that is slightly curved downward. It may also be cut in a straight line. A virtual straight line connecting both ends of the waist line is cut at an angle α of 35° with respect to the knitting direction 9 (consequently, the cutting angle of A-B is 180°−35°=145°). Since the actual waist line is a curved line that is slightly curved downward, the actual cutting angle α is an angle that surpasses and falls below 35° (cutting angle of 145°). That is to say, the direction of the bottom line 2 and the direction of the waist line 3 are not parallel to one another and they have different shapes (see FIG. 3, as this is not evident in FIG. 1 and FIG. 2).

The abdomen portion covering piece 6 has a 1×1 tricot structure in which an elastic yarn and an non-elastic yarn run in different directions, made from a cloth with the above-mentioned knitting structure such that the elastic yarn forms closed loops and the non-elastic yarn form open loops. Its upper edge 7 is an edge that does not require hem finishing when left as cut, and forms a curved line that is slightly curved downward. It should be noted that it can also be cut to a straight line and form a waist line. Alternatively, another fabric that requires hem finishing may be used for the abdomen portion covering piece 6, as appropriate. The abdomen portion covering piece 6 is knitted from a 44 dtex nylon yarn and 88 dtex polyurethane yarn, at a knitting density of 68 wales per inch (2.54 cm). The upper edge 7 of the abdomen portion covering piece 6, which abuts the waist line, is cut at an angle of 40° with respect to the knitting direction. Thus, all of the garment edge portions at the waist and the bottom line can be made as edge portions that are left as cut and not hem-finished, and the girdle is formed from pieces that are vertically continuous and do not have a level difference, so that the number of sewing spots can be reduced and a girdle with few level differences can be attained. In particular, the level differences at the edge portions can be eliminated, the cutting angle is at least 3° with respect to the knitting direction, and the cutting shape is a curved line or wave shape, so that the waist line and the bottom line are not frayed when left as cut, the girdle fits the wearer's body without curling, is not easily displaced, and waist and bottom line can be easily held in a stable position, which is preferable. It is also possible to partially knit in or insert a further elastic yarn or non-elastic yarn into the abdomen portion covering piece 6 or the side front—side—hip portion—leg portion covering piece 1, thus providing a portion with little stretch.

As described above, the bottom line 2 and the waist line 3 are edges that do not require hem finishing when left as cut, and since they do not require hem finishing and do not use a rubber tape or the like, the waist is not firmly tied together in a line shape as with a rubber tape and the thickness is not increased, so that a clear-cut silhouette around the waist is achieved when wearing, and there are also no wear marks from a rubber tape left on the skin. This is also similar around the bottom line portion. The side front—side—hip portion—leg portion covering piece 1 and the abdomen portion covering piece 6 are not limited to the above-mentioned knitting structures, and may have any kind of knitting structure, as long as they are tricot warp-knitted fabrics that do not fray when left as cut.

EXAMPLE 2

Figure 4:
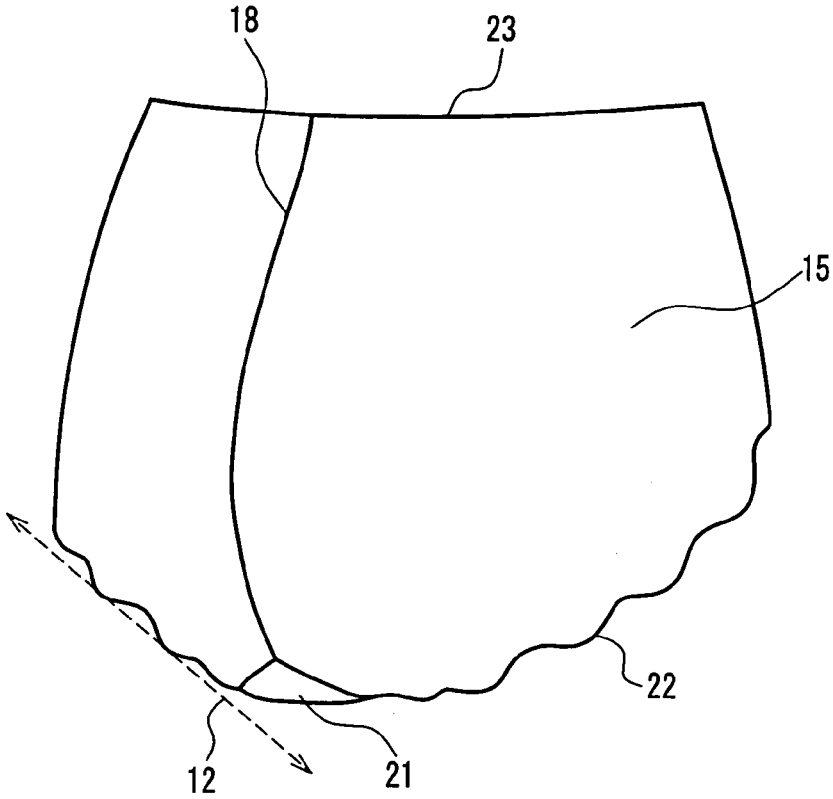
FIG. 4 is a perspective view showing a short girdle according to an embodiment of the present invention of a garment that has an edge that does not require hem finishing when left as cut, seen from the rear side.
Figure 5:
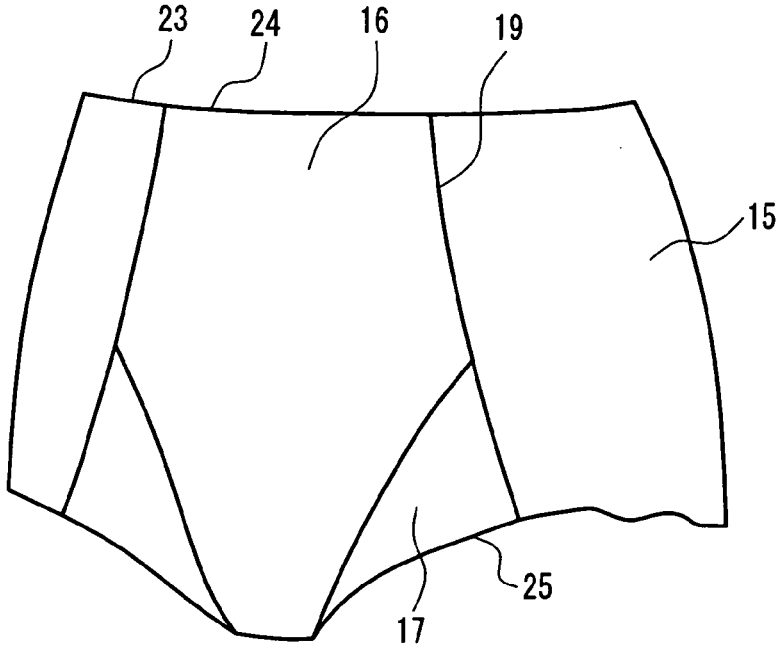
FIG. 5 is a perspective view showing the short girdle of FIG. 4, seen from the front side.
Figure 6:
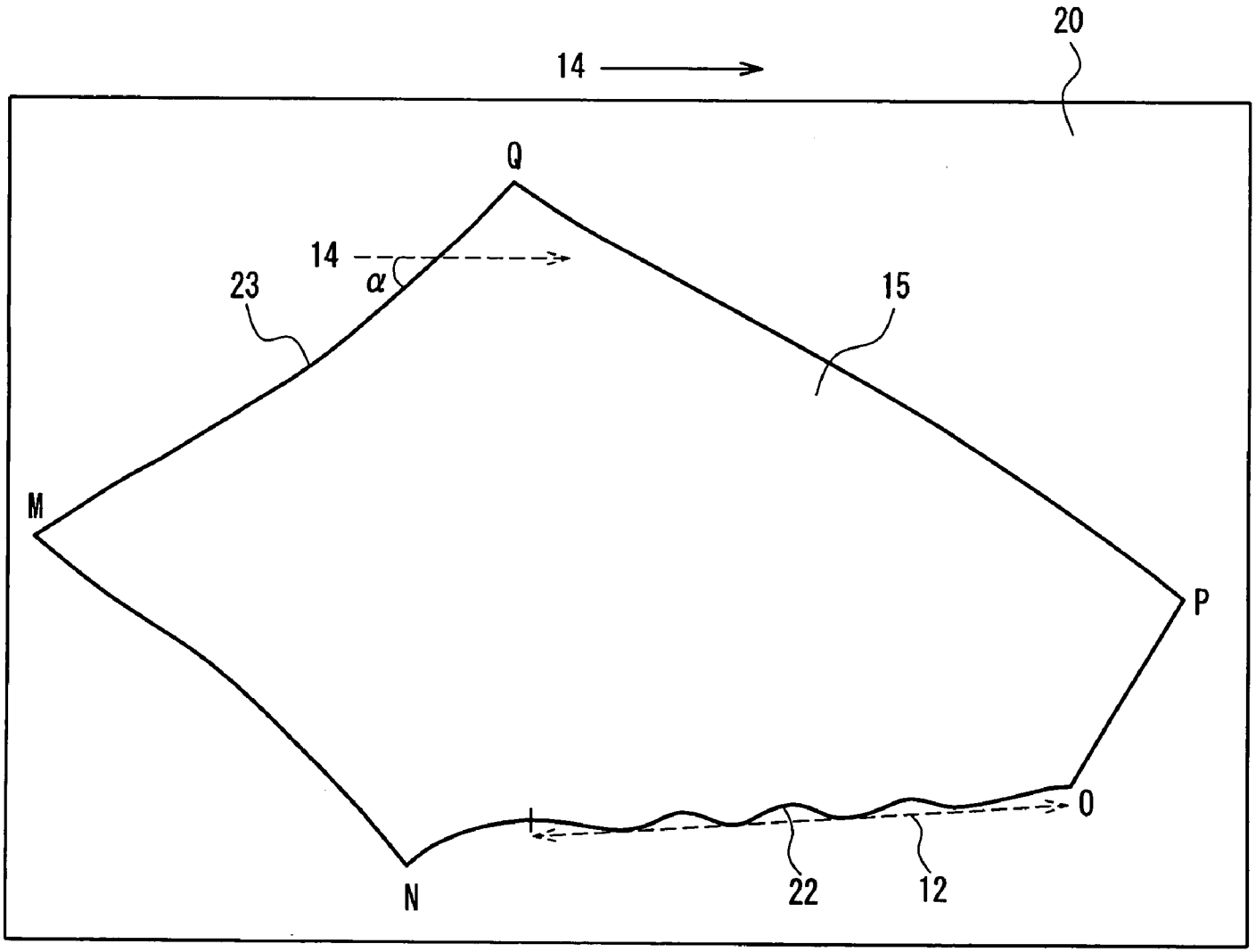
FIG. 6 is a plane view showing, on a knitted fabric, a cutting line of a side front—side—hip portion covering piece 15, corresponding to the left side of the wearer of the short girdle shown in FIG. 4 and FIG. 5.

FIG. 4 is a perspective view showing a short girdle according to an embodiment of the present invention of a garment that has an edge that does not require hem finishing when left as cut and that has a body-shaping function, seen from the rear side. FIG. 5 is a perspective view showing the short girdle of FIG. 4, seen from the front side. FIG. 6 is a plane view showing, on a knitted fabric, a cutting line of a side front—side—hip portion covering piece 15, corresponding to the left side of the wearer of the short girdle shown in FIG. 5.

In FIGS. 4 to 6, reference numeral 15 denotes the side front—side—hip portion covering piece covering a side front—side—back portion, which is continuous in the vertical direction and made of one piece without a level difference. Reference numeral 16 denotes an abdomen covering piece covering the abdomen, which is continuous in the vertical direction and made of one piece without a level difference. Reference numeral 17 denotes a front center bottom piece, which is continuous in the vertical direction and made of one piece without a level difference. The side front—side—hip portion covering pieces 15 on the left and right are sewn together by a rear center seam line 18, and the side edges on the front side of the side front—side—hip portion covering pieces 15 are sewn to the side edges of the abdomen portion covering piece 16 and the front center bottom piece 17 at a seam line 19.

The line M-N-O-P-Q-M shown on the fabric 20 in FIG. 6 indicates the cutting line of the side front—side—hip portion covering piece 15 for obtaining the piece of the half on the left side of the wearer, which is used for the portion from the side of the girdle to the hip portion.

Although it is not shown in the drawings, the shape of the side front—side—hip portion covering piece 15 for the right half is the mirror symmetric shape of the portion for the left half. The line M-N is sewn to the abdomen portion covering piece 16 and the front center bottom piece 17 in FIG. 5, and the line P-Q is sewn to the corresponding portion of the afore-mentioned piece of the right half (not shown in the drawings), forming the rear center seam line 18. The line O-P is sewn to a crotch portion 21. The line N-O forms a bottom line, and the line Q-M forms a waist line. The sewing for the piece 15 of the right half, which is not shown in the drawings, is similar, because it is left-right symmetric. In this manner, the girdle shown in FIGS. 4 and 5 can be fabricated.

For the side front—side—hip portion covering piece 15, the abdomen portion covering piece 16 and the front center bottom piece 17, pieces are used that have edges that do not require hem finishing when left as cut. The knitting direction of the warp-knitted fabric constituting the side front—side—hip portion covering piece 15 is indicated by the arrow direction of arrow 14.

The side front—side—hip portion covering piece 15 has a 1×1 tricot structure in which a nylon yarn and a polyurethane yarn run in different directions as shown in FIG. 11, and is knitted at a knitting density of 70 wales per inch (2.54 cm) such that both the elastic yarn and the non-elastic yarn form closed loops. It is knitted from a 33 dtex nylon yarn and a 77 dtex polyurethane yarn. The edge of the side front—side—hip portion covering piece 15, which does not require hem finishing when left as cut, forms an edge of a bottom line 22 and an edge of a waist line 23. The bottom line 22 is wave-shaped, and the direction of the bottom line 22 is the same direction as the straight line connecting the crests of this wave shape, that is, the direction indicated by arrow 12, and forms an angle of 5° with the knitting direction 14. The waste line 23 is cut at an angle α (cutting angle) of about 40° with respect to the knitting direction 14. The waist line 23 is a curved line that is slightly curved downward, so that the curved portion is cut at an angle that surpasses and falls below 40°. In any case, the bottom line 22 and the waist line 23 are not parallel and have different shapes.

The bottom line 22 is cut overall at an angle of 5° (the cutting angle is 180°−5°=175°), but the overall bottom line is cut to a wave shape with a plurality of waves, so that the wave-shaped line is cut at an angle exceeding 5° (i.e. an angle that is smaller than 175° in terms of the cutting angle). The waist line 23 is a curved line that is slightly curved downward, and the virtual straight line connecting Q and M at the two ends of the waist line is an edge that is cut at an angle of 40° (cutting angle) with respect to the knitting direction 14 of the knitted fabric. The waist line 23 is a curved line that is slightly curved in downward direction of the garment, so that the actual cutting angle is an angle that surpasses and falls below 40°. That is to say, the waist line 23 forming the edge at the upper side is not parallel to the bottom line 22 forming the edge at the lower side.

As noted above, the edge 24 at the upper side of the abdomen portion covering piece 16 is an edge that does not require hem finishing when left as cut. It has a 1×1 tricot structure in which non-elastic yarn and elastic yarn run in the same direction, as shown in FIG. 10, and uses a knitted fabric in which both the elastic yarn and the non-elastic yarn form open loops. The abdomen portion covering piece 16 uses a 44 dtex nylon yarn and a 154 dtex polyurethane yarn, and is knitted at a knitting density of 65 wales per inch (2.54 cm). It is cut at an angle of 45° with respect to the knitting direction. The front center bottom piece 17 has a 1×1 tricot structure in which non-elastic yarn and elastic yarn run in the same direction, as shown in FIG. 10, and uses a knitted fabric in which both the elastic yarn and the non-elastic yarn form open loops. It is knitted from a 33 dtex nylon yarn and a 77 dtex polyurethane yarn, at a knitting density of 70 wales per inch (2.54 cm). A bottom line 25 of the front center bottom piece 17 is formed from an edge that does not require hem finishing when left as cut, and is cut at an angle of about 25° with respect to the knitting direction. Moreover, it is a curved line that is curved sagging downward (concave), and the curved portion is cut at an angle that surpasses and falls below 25°. It should be noted that the bottom line may also be a straight line. Moreover, it is also possible to use a knitted piece provided with an edge that does not require hem finishing, obtained by the conventional method of pulling out yarn.

Thus, all of the garment edge portions at the waist and the bottom line can be edge portions that are left as cut and not hem-finished, and the girdle is formed using pieces 15 that are vertically continuous and do not have a level difference, so that the number of sewing portions can be reduced and a girdle with few level differences having flat surface can be attained. In particular, the level differences of the edge portion can be eliminated, the cutting angle is at least 3° (180°−3°=177° or less) with respect to the knitting direction, and the cutting shapes are curved lines or wave shapes, so that the waist line and the bottom are not frayed when left as cut, and the girdle fits the wearer's body without curling, is not easily displaced, and waist and bottom can be easily held in a stable position, which is preferable.

As described above, the bottom line 22, 25 and the waist line 23 are edges that do not require hem finishing when left as cut, and since they do not require hem finishing and do not use a rubber tape or the like, the waist is not firmly tied together in a line shape as with a rubber tape and the thickness is not increased, so that a clear-cut silhouette around the waist is achieved when wearing, and there are also no wear marks from a rubber tape left on the skin. This is also similar around the bottom portion. The side front—side—hip portion covering piece 15, the abdomen portion covering piece 16 and the front center bottom piece 17 are not limited to the above-mentioned knitting structures, and may have any knitting structure, as long as it is a tricot warp-knitted fabric that does not fray when left as cut.

EXAMPLE 3

Figure 17:
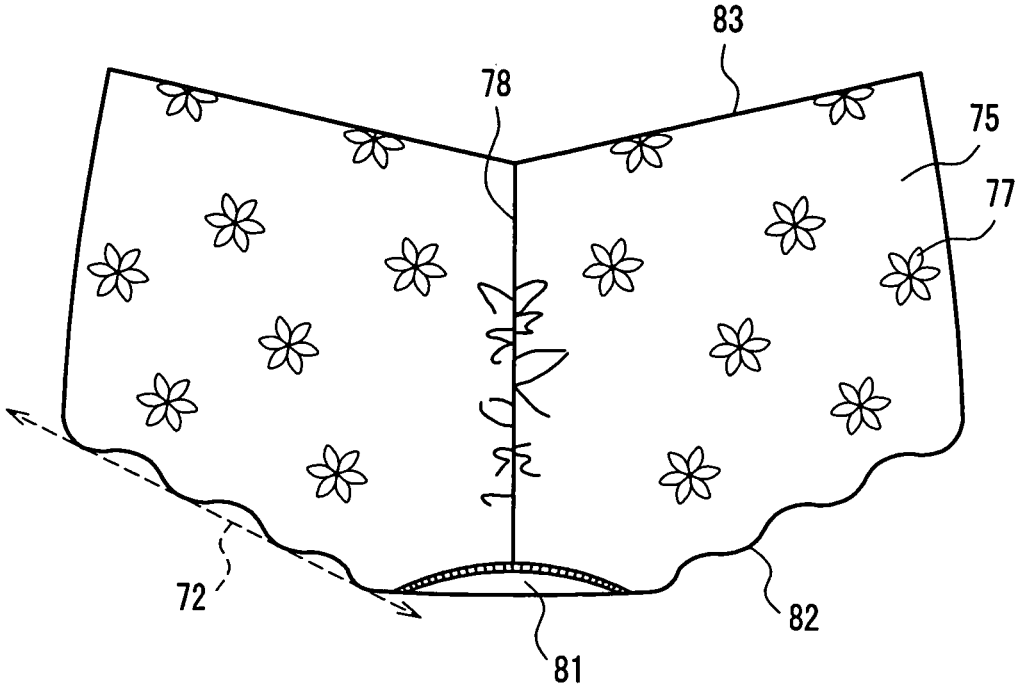
FIG. 17 is a rear view of a short panty according to an embodiment of the present invention of a garment having an edge that does not require hem finishing when left as cut.
Figure 18:
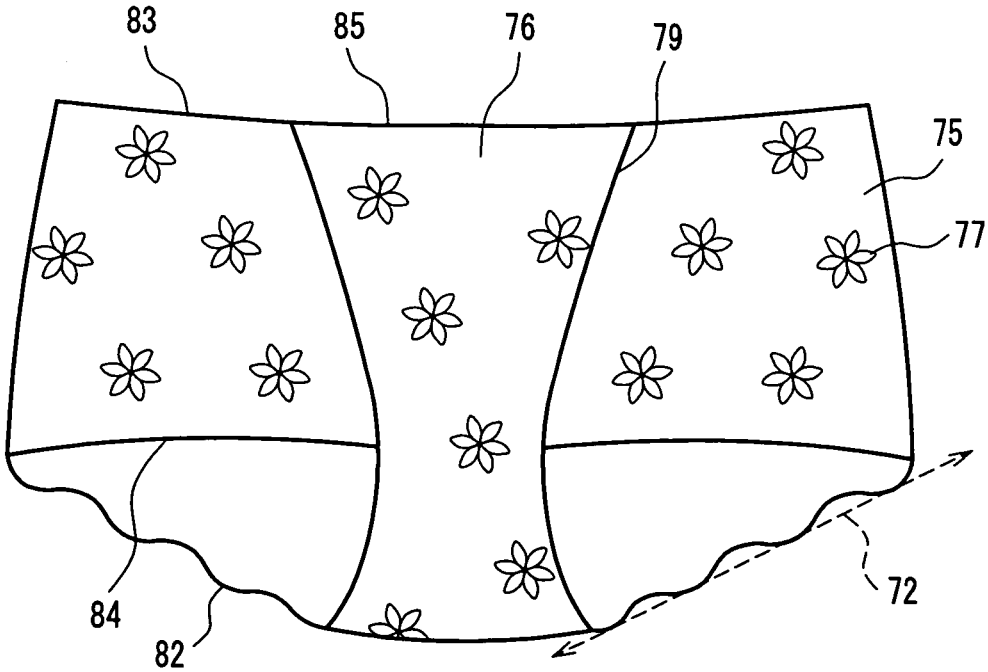
FIG. 18 is a front view of the short panty shown in FIG. 17.
Figure 19:
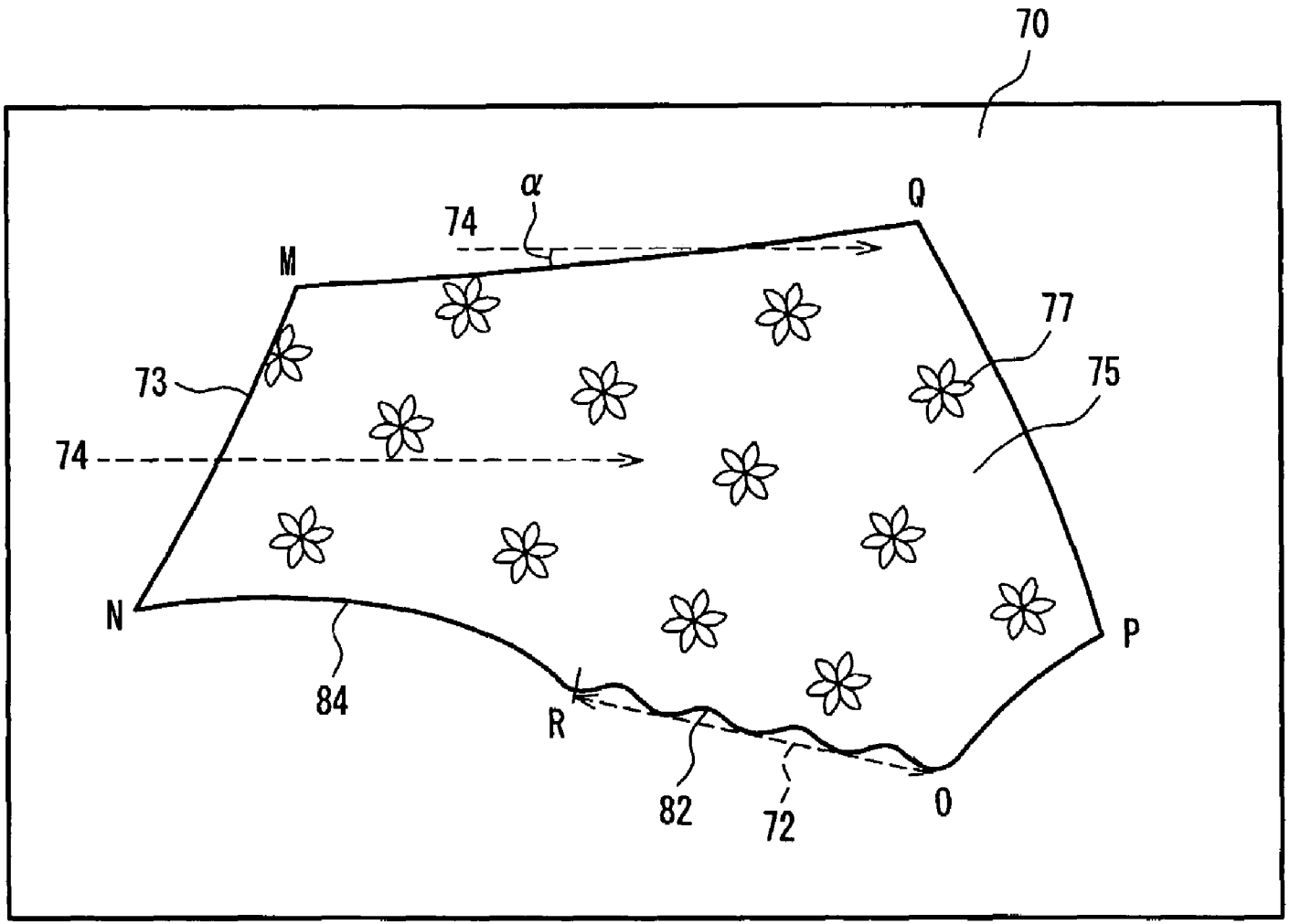
FIG. 19 is a plane view showing, on a knitted fabric, a cutting line of a front flank—side—hip portion covering piece 75, corresponding to the left side of the wearer of the short panty shown in FIGS. 17 and 18.

FIG. 17 is a rear view of a short panty according to an embodiment of the present invention of a garment having an edge that does not require hem finishing when left as cut. FIG. 18 is a front view of the short panty shown in FIG. 17. FIG. 19 is a plane view showing, on a knitted fabric, a cutting line of a front flank—side—hip portion covering piece 75, corresponding to the left side of the wearer of the short panty shown in FIGS. 17 and 18.

In FIGS. 18 and 19, reference numeral 75 denotes the front flank—side—hip portion covering piece covering the front flank—side—back portion, which is continuous in the vertical direction and made of one piece without a level difference. Reference numeral 76 denotes an abdomen—crotch covering piece which covering the abdomen and crotch portion, which is continuous in the vertical direction and made of one piece without a level difference. The front flank—side—hip portion covering pieces 75 on the left and right are sewn together by a rear center seam line 78, and the side edges on the front of the front flank—side—hip portion covering pieces 75 are sewn to a portion of the side edges of the abdomen—crotch covering piece 76 with a seam line 79. That is to say, this short panty is made of three pieces.

The line M-N-O-P-Q-M shown on the fabric 70 in FIG. 19 indicates the cutting line of the front flank—side—hip portion covering piece 75 for obtaining the piece of the half on the left side of the wearer, which is used for the portion from the side of the short panty to the hip portion.

Although it is not shown in the drawings, the shape of the front flank—side—hip portion covering piece 75 for the right half is the left-right symmetric shape of the portion for the left half. The line M-N is sewn to a portion of the abdomen—crotch covering piece 76 in FIG. 18, and the line P-Q is sewn to the corresponding portion of the afore-mentioned piece of the right half (not shown in the drawings), forming the rear center seam line 78. The line O-P is sewn to a crotch rear portion 81 of the abdomen—crotch covering piece 76. The line N-O forms a bottom line (of the line N-O, the line N-R is a front bottom line 84, and the line R-O is a rear bottom line 82), and the line Q-M forms a waist line 83. The sewing for the piece 75 of the right half, which is not shown in the drawings, is similar, because it is left-right symmetric. In this manner, the short panty shown in FIGS. 18 and 19 can be fabricated.

For the front flank—side—hip portion covering piece 75 and the abdomen—crotch covering piece 76, pieces are used that do not require hem finishing when left as cut. The knitting direction of the warp-knitted fabric constituting the front flank—side—hip portion covering piece 75 is indicated by the arrow direction of arrow 74.

For the front flank—side—hip portion covering piece 75 and the abdomen—crotch covering piece 76, the knitted fabric of the base knit has a 1×1 tricot structure in which a 33 dtex nylon yarn and 77 dtex polyurethane yarn run in the same direction forming closed loops, knitted at a knitting density of 63 wales per inch (2.54 cm). As a pattern yarn that is Jacquard controlled in order to form a fine Jacquard pattern (flower pattern with 4 cm maximal diameter) 77, a 33 dtex nylon yarn is used. The portion where the pattern yarn does not form a pattern has a 1×1 tricot structure in which the pattern yarn runs in a different direction to an elastic yarn forming closed loops, and in the portion where the fine Jacquard pattern is expressed, a flower pattern 77 is formed by chain stitches. It should be noted that the portion expressing the fine Jacquard pattern may also be an atlas stitch.

The edge of the front flank—side—hip portion covering piece 75, which does not require hem finishing when left as cut, forms an edge of a bottom line 84 and a rear bottom line 82, and an edge of a waist line 82. The rear bottom line 82 is wave-shaped, and the direction of the rear bottom line 82 is the same direction as the straight line connecting the crests of this wave shape, that is, the direction indicated by arrow 72, and forms an angle of 5° with the knitting direction 74. As shown in FIG. 19, the front bottom line 84 (N-R) has an upwardly slightly convex irregular curve shape. The waste line 83 is cut at an angle $\alpha$ (cutting angle) of 3° with respect to the knitting direction 74. Consequently, the bottom line 82 and the waist line 83 are not parallel.

As noted above, the edge 85 at the upper side of the abdomen—crotch covering piece 76 is an edge that does not require hem finishing when left as cut. For the knitted fabric, the same knitted fabric provided with the same fine Jacquard pattern as the front flank—side—hip portion covering piece 75 was used.

The knitting direction and the direction of the cutting edges of the abdomen—crotch covering piece 76 are not shown in the drawings, but the abdomen—crotch covering piece 76 was cut such that its upper edge 85 formed an angle of 45° with respect to the knitting direction.

Thus, all of the garment edge portions at the waist and the bottom can be made of edge portions that are left as cut and not hem-finished, and the short panty is formed from pieces that are vertically continuous and do not have a level difference, so that the number of sewing portions can be reduced and a short panty with a small flower pattern and having a flat surface with few level differences can be attained. In particular, the level differences of the edge portion can be eliminated, the cutting angle is at least 3° (180°−3°=177° or less) with respect to the knitting direction, and the cutting shape is a curved line or wave shape, so that the waist line and the bottom are not frayed when left as cut, and the girdle fits the wearer's body without curling, is not easily displaced, and waist and bottom can be easily held in a stable position, which is preferable.

As described above, the bottom line 82, 84 and the waist line 83 are edges that do not require hem finishing when left as cut, and since they do not require hem finishing and do not use a rubber tape or the like, the waist is not firmly tied together in a line shape as with a rubber tape and the thickness is not increased, so that a clear-cut silhouette around the waist is achieved when wearing, and there are also no wear marks from a rubber tape left on the skin. This is also similar around the bottom portion. The front flank—side—hip portion covering piece 75 and the abdomen—crotch covering piece 76 are not limited to the above-mentioned knitted structures, and may have any kind of knitting structure, as long as it is a tricot warp-knitted fabric that does not fray when left as cut.

EXAMPLE 4

Figure 7:
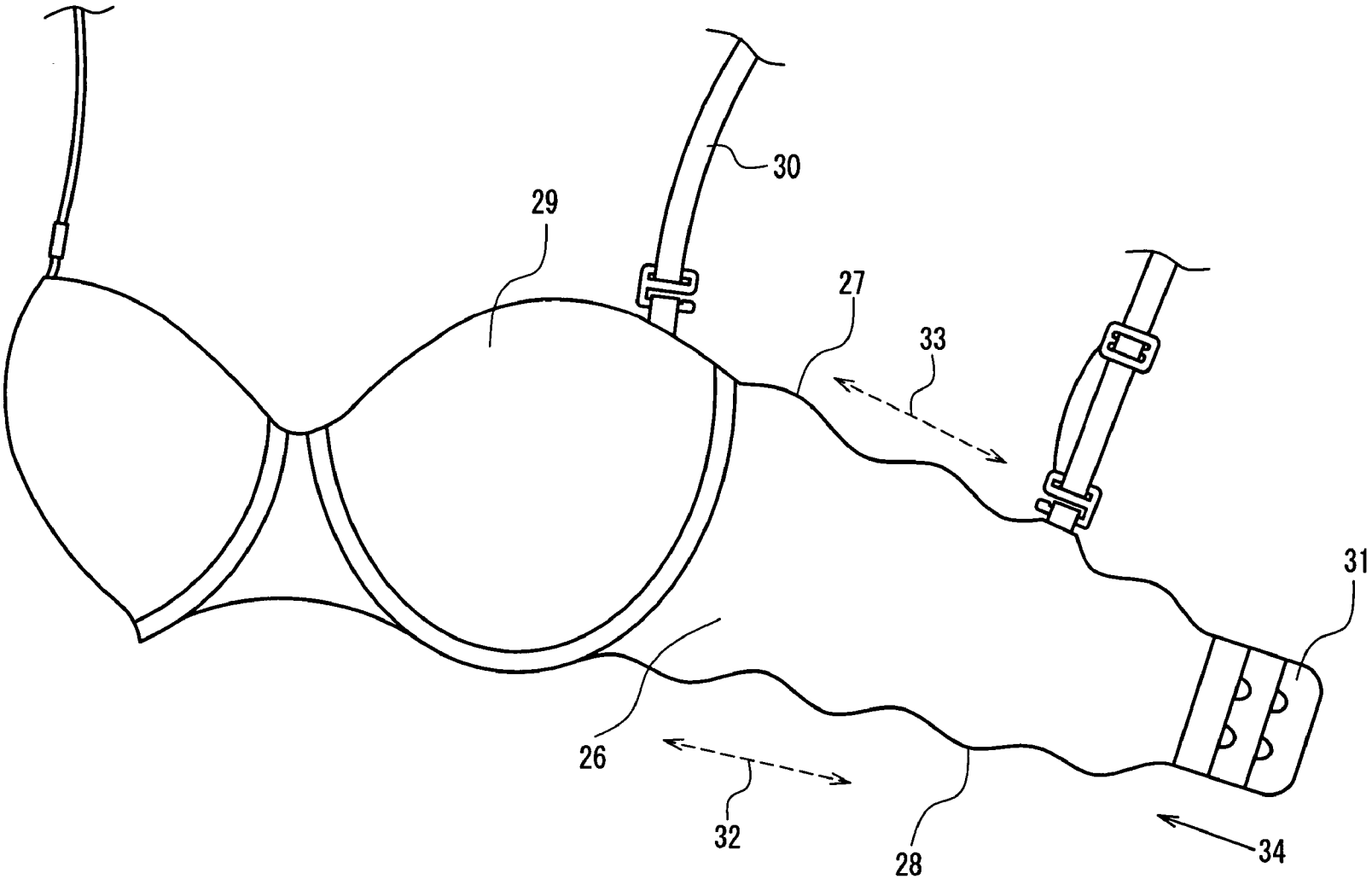
FIG. 7 is a perspective view of a brassiere according to an embodiment of the present invention of a garment having an edge that does not require hem finishing when left as cut, seen from the front side.

FIG. 7 is a perspective view of the principal portions of a brassiere according to an embodiment of the present invention of a garment having an edge that does not require hem finishing when left as cut. In FIG. 7, reference numeral 26 denotes a stretchable back cloth, reference numeral 31 denotes a linking portion for linking the left and right back cloth when wearing the brassiere, reference numeral 29 denotes a breast cup, and reference numeral 30 denotes a strap. The stretchable back cloth 26 is a piece that does not require hem finishing when left as cut, and is formed using one piece that is continuous in the vertical direction. The knitting direction of the warp-knitted fabric constituting this piece is the direction indicated by arrow 34. If the knitting direction is the direction from the smaller width of the back cloth to the larger width of the back cloth, then the cloth can be cut from the knitting start side, so that fraying occurs less easily. It should be noted that, although not shown in the drawings, the knitting direction of the back cloth placed on the right side of the wearer is the direction pointing in the opposite direction of the arrow 34. That is to say, the knitting direction is the direction from the smaller width of the back cloth to the larger width of the back cloth.

The back cloth piece 26 has a 1×1 tricot structure in which a 33 dtex nylon yarn and a 44 dtex polyurethane yarn run in different directions as shown in FIG. 11, and is knitted such that both the elastic yarn and the non-elastic yarn form closed loops. It is knitted at a knitting density of 63 wales per inch (2.54 cm).

The edges of the back cloth 26 that do not require hem finishing when left as cut are the portions of the lower edge 28 and the upper edge 27 of the back cloth. The lower edge 28 and the upper edge 27 are both wave-shaped with a plurality of waves. For the wave shapes, convex and concave portions are arranged at substantially the same intervals and with substantially same height in the upper edge 27 and the lower edge 28, and appear at substantially the same location at top and bottom. That is to say, the wave shape is substantially mirror symmetric with the center line bisecting the back cloth in upper half and lower half as the symmetry line, so that where the upper edge 27 has an upward-pointing convex portion, the lower edge 28 has a downward-pointing convex portion, and where the upper edge 27 has a downward-pointing concave portion, the lower edge 28 has an upward-pointing concave portion. It should be noted that in the present example, the back cloth 26 is linked to the cup portion, forming a brassiere without under-cup cloth. In case of brassieres with under-cup cloth that are made of a cloth in which the back cloth is linked to the under-cup cloth, the wave line should be substantially mirror symmetric with respect to the center line bisecting the back cloth in upper half and lower half at the back portion outside the under-cup portion.

The upper and lower edges of the back cloth or under-cup cloth, which do not require hem finishing, are not limited to wave shapes, and may also be straight or of a curved shape other than a wave shape. Moreover, the wave shape may be an even or an uneven wave shape. Moreover, the shapes of the upper edge and the lower edge may be the same or different. The direction of the edge line of the lower edge 28 of the back cloth 26 is the same direction as the straight line connecting the crests of this wave shape, that is, the direction indicated by arrow 32, and forms an angle of 6° with the knitting direction. The direction of the edge line of the upper edge of the back cloth 27 is the same direction as the straight line connecting the crests of this wave shape, that is, the direction indicated by arrow 33, and forms an angle of 6° with the knitting direction. That is to say, the lines constituting the upper and lower edges of the back cloth, which do not require hem finishing when left as cut, are not parallel to one another. It should be noted that the edge lines are wave-shaped, so that portions of the wave shapes are cut at angles exceeding 6°. The broadest width of the back cloth is set to 9 cm and the narrowest width is set to 4 cm.

In the back cloths of conventional brassieres, a rubber tape is provided along the upper and lower edges of the back cloth 26, but no rubber tape is sewn to the upper and lower edges of the back cloth 26 of the brassiere of the present embodiment, so that there is no increase in thickness due to any rubber tape, a clear-cut silhouette around the bust is achieved when wearing, and there are also no wear marks from a rubber tape left on the skin. Consequently, the back cloth fits the body, and the edge portions fit the body closely without curling, displacements when moving are reduced to a minimum, preventing the garment from becoming loose.

In order to increase the strength of the back cloth, it is also possible two vertically continuous pieces are laminated by bonding together with resin or the like. It is also possible to form the back cloth with one piece of cloth, but in the present embodiment, two like pieces having the same shape that were bonded together with resin were used. When bonding together two pieces with resin, they can be more easily bonded together if they are layered such that the knitting directions of the two pieces are the same. If the back cloth piece is cut after the two vertically continuous cloths were laminated by bonding together, then the edge portions become neat. Also if the back cloth is made of two pieces that are bonded together, the two pieces are bonded together into one and the upper edge and the lower edge of the back cloth do not require hem finishing, the back cloth is made of a vertically continuous cloth, the surface is flat and without level differences from the upper edge to the lower edge, and there is no partial pressure when wearing. Also when made of one piece, the knitted fabric used for the back cloth piece is a cloth whose cut edge portions do not easily fray, and since it is cut to a shape and angle at which the edge portions do not fray, the cut ends of the upper and lower edge portions are neat, and yarn end does not protrude from them.

EXAMPLE 5

Figure 8:
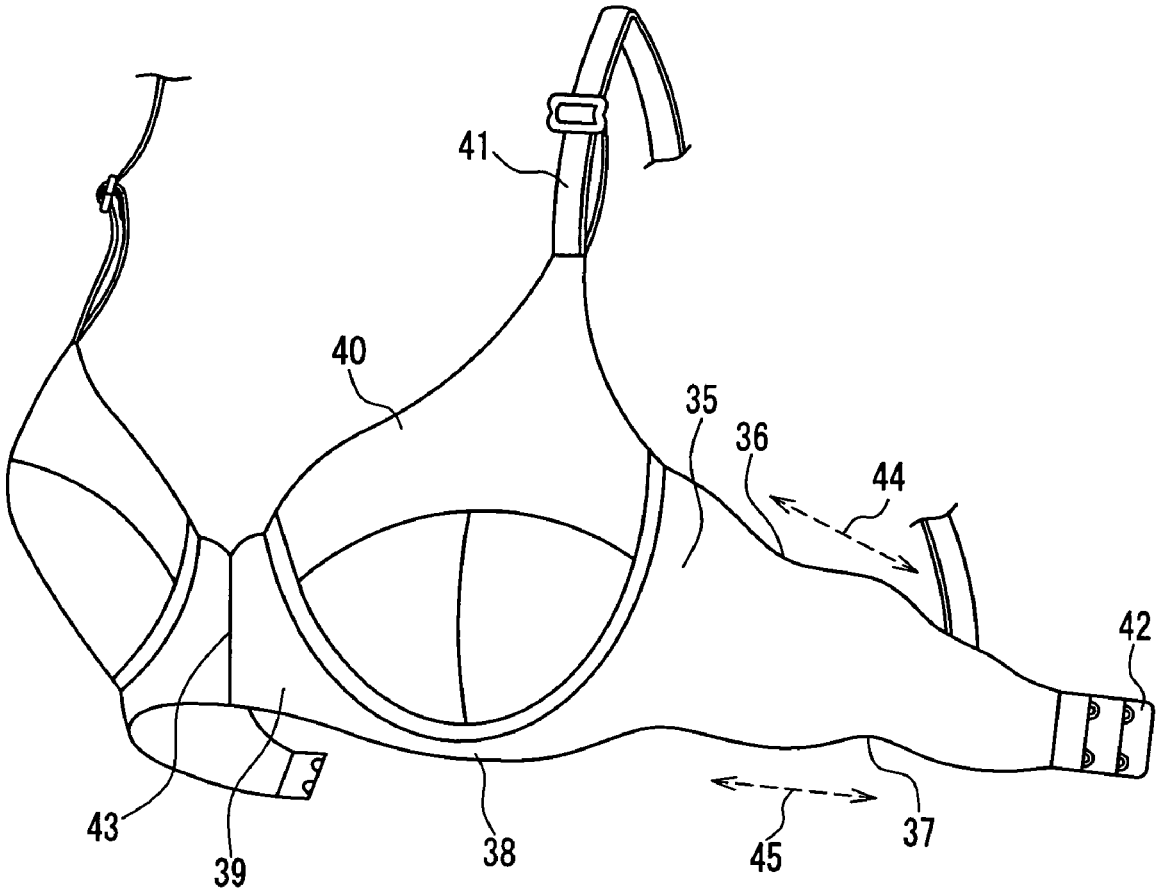
FIG. 8 is a perspective view of a brassiere according to an embodiment of the present invention of a garment having an edge that does not require hem finishing when left as cut, seen from the front side.
Figure 9:
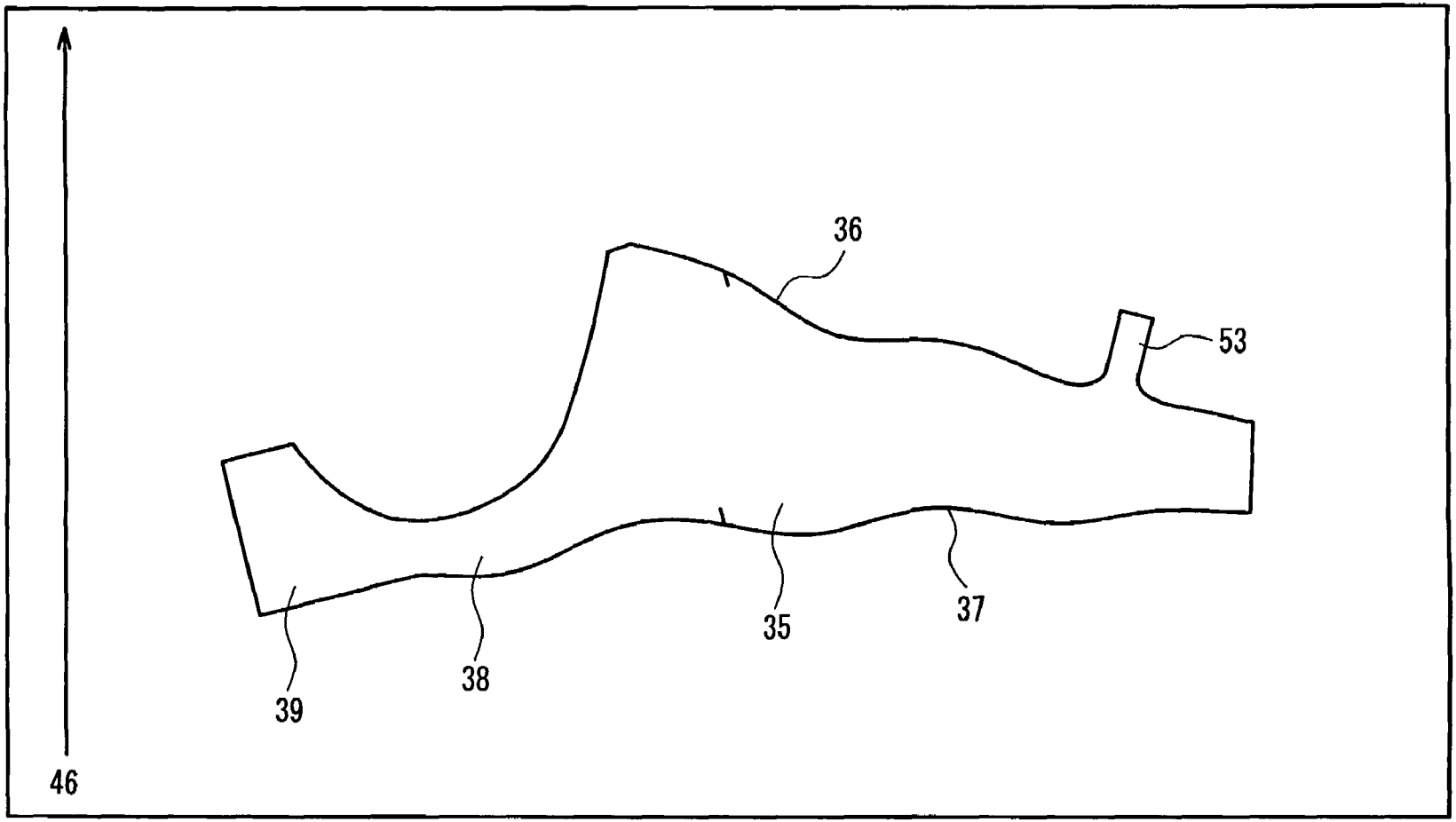
FIG. 9 is a plane view showing, on a knitted fabric, a cutting line of a back cloth piece 35, an under-cup portion 38, and a front center portion 39, corresponding to the left side of the wearer of the brassiere shown in FIG. 8.

FIG. 8 is a perspective view of the principal portions of a brassiere according to an embodiment of the present invention of a garment having an edge that does not require hem finishing when left as cut. FIG. 9 is a plane view showing, on a knitted fabric, a cutting line of a back cloth piece 35, corresponding to the left side of the wearer of the brassiere shown in FIG. 8. In FIG. 8, reference numeral 35 denotes a stretchable back cloth, reference numeral 38 denotes an under-cup portion, reference numeral 39 denotes a front center portion, reference numeral 42 denotes a linking portion for linking the left and right back cloth when wearing the brassiere, reference numeral 40 denotes a breast cup, reference numeral 41 denotes a strap, and reference numeral 43 denotes the location where the left and right front center portions are sewn together. The back cloth portion, the under-cup portion and the front center portion are made of one continuous piece of cloth. The stretchable back cloth 35 is a piece that does not require hem finishing when left as cut, and is formed using a cloth that is continuous in the vertical direction. The knitting direction of the warp-knitted fabric constituting this piece is the direction indicated by arrow 46 (see FIG. 9).

The back cloth piece 35 has a 1×1 tricot structure in which a 33 dtex nylon yarn and a 44 dtex polyurethane yarn running in different directions, and is knitted such that the elastic yarn forms open loops and the non-elastic yarn forms closed loops. It is knitted at a knitting density of 63 wales per inch (2.54 cm).

The edges of the back cloth 35 that do not require hem finishing when left as cut are the portions of the lower edge 37 and the upper edge 36 of the back cloth. The lower edge 37 and the upper edge 36 are both wave-shaped with a plurality of waves. For the wave shapes, mutually different convex and concave portions are arranged at the upper and the lower edges at substantially the same intervals and with substantially same height in the upper edge 36 and the lower edge 37. That is to say, where the upper edge 36 has an upward-pointing convex portion, the lower edge 37 has an upward-pointing concave portion, and where the upper edge 36 has a downward-pointing concave portion, the lower edge 37 has a downward-pointing convex portion. Thus, the lower edge 37 and the upper edge 36 have a similar wave shape, and also the overall back cloth is wave-shaped. It should be noted that in this example, the back cloth 35, the under-cup portion and the front center portion are formed from a continuous cloth. The edge on the lower side of the under-cup portion and the front center portion may be wave-shaped or have the shape of a straight line. If stretching of the front center portion is to be stopped, then the outward surface of the front center portion should be laminated to a cloth without extensibility.

The direction of the edge line of the lower edge 37 of the back cloth 35 is the same direction as the straight line connecting the crests of this wave shape, that is, the direction indicated by arrow 45, and forms an angle of 85° (cutting angle) with the knitting direction. The direction of the edge line of the upper edge of the back cloth 36 is the same direction as the straight line connecting the crests of this wave shape, that is, the direction indicated by arrow 44, and forms an angle of 95° (cutting angle) with the knitting direction. That is to say, the lines constituting the upper and lower edges of the back cloth, which do not require hem finishing when left as cut, are not parallel to one another. It should be noted that since the edge lines are wave-shaped, the wave-shaped portions of the edge line of the lower edge 37 are cut at an angle that surpasses and falls below 85° and the wave-shaped portions of the edge line of the upper edge 36 are cut at an angle that surpasses and falls below 95°. The under-cup portion 38 and the front center portion 39 are cut at an angle that is smaller than 85°. The wave-shaped portion of the under-cup portion 38 is cut at an angle that surpasses and falls below 85°.

Reference numeral 53 denotes a strap attachment location. A strap 41 is attached by passing the strap 41 through a strap attachment ring at the strap attachment location 53, folding the strap attachment location 53 in two, and sewing its front end to the back cloth 35. The strap attachment location 53 is continuous with the back cloth 35, and is cut in one piece with the back cloth. Its edge portion is left as cut and does not require hem finishing. The broadest width of the back cloth 35 is set to 9 cm and the narrowest width is set to 4 cm.

In the back cloths of conventional brassieres, a rubber tape is provided along the upper and lower edges of the back cloth 35, but no rubber tape is sewn to the upper and lower edges of the back cloth 35 of the brassiere of the present embodiment, so that there is no increase in thickness due to any rubber tape, a clear-cut silhouette around the bust is achieved when wearing, and there are also no wear marks from a rubber tape left on the skin. Consequently, the back cloth fits the body, and the edge portions fit the body closely without curling, displacements when moving are reduced to a minimum, preventing the garment from becoming loose.

In order to increase strength of the back cloth, it is also possible to laminate two vertically continuous pieces by bonding together with resin or the like. It is also possible to form the back cloth with one piece of cloth, but in the present embodiment, two like pieces having the same shape that were laminated by bonding together with resin were used.

When bonding together two pieces with resin, they can be more easily bonded together if they are layered such that the knitting directions of the two pieces are the same. If the back cloth piece is cut after the two vertically continuous cloths were laminated by bonding together, then the edge portions become neat. Also if the back cloth is made of two pieces that are laminated by bonding together, the two pieces are layered and bonded together into one and the upper edge and the lower edge of the back cloth do not require hem finishing, the back cloth is made of a vertically continuous cloth, the surface is flat and without level differences from the upper edge to the lower edge, and there is no partial pressure when wearing. Also when made of one piece, it is a cloth whose cut edge portions do not easily fray, and since it is cut to a shape and angle at which the edge portions do not fray, the cut ends of the upper and lower edge portions are neat, and yarn end does not protrude from them.

EXAMPLE 6

A brassiere was fabricated in substantially the same manner as in Example 4. What is different to Example 4 is mainly that when the two pieces forming the back cloth are laminated by bonding together with a thermobonding resin in order to increase the strength of the back cloth, a piece made by laminating two pieces corresponding to (B-1) mentioned above was used.

Unless indicated otherwise, other aspects are similar to Example 4 and FIG. 7, so that duplicate explanations for like aspects have been omitted.

As the piece corresponding to the above-noted (B-1) of the piece forming the back cloth, a back cloth piece was used that was made as follows: Two warp-knit fabrics were made using a cotton yarn with a yarn number of 80 for the non-elastic yarn and a 78 dtex polyurethane yarn for the elastic yarn (with a usage ratio of 65 wt % cotton and 35 wt % polyurethane), with the non-elastic yarn arranged in a 1×1 tricot structure (Denbigh structure) and the elastic yarn arranged in a half structure, and the non-elastic yarn and the elastic yarn both forming closed loops, as shown in FIG. 12 and FIG. 13, and the knitting density in wales being 65/inch (knitting density of 65 wales per inch (2.54 cm)). The two knits were laid on top of each other such that their knitting direction was the same and bonded together with a resin, and then cut to a similar constitution and similar shape as that of the back cloth 26 shown in FIG. 7.

In the back cloths of conventional brassieres, a rubber tape is provided along the upper and lower edges of the back cloth 26, but no rubber tape is sewn to the upper and lower edges of the back cloth 26 of the brassiere of the present embodiment, so that there is no increase in thickness due to any rubber tape, a clear-cut silhouette around the bust is achieved when wearing, and there are also no wear marks from a rubber tape left on the skin. Consequently, the back cloth fits the body, and the edge portions fit the body closely without curling, displacements when moving are reduced to a minimum, preventing the garment from becoming loose.

Since the back cloth is made of two knitted fabrics that are laminated together, the tear strength is large, and the upper edge and the lower edge of the back cloth do not require hem finishing, the back cloth is made of a vertically continuous cloth, the surface is flat and without level differences from the upper edge to the lower edge, and there is no partial pressure when wearing. The knitted fabric used for the back cloth piece is a cloth whose cut edge portions do not easily fray, and since it is cut to a shape and angle at which the edge portions do not fray, the cut ends of the upper and lower edge portions are neat, and yarn ends do not protrude from them. Moreover, the knitted fabric used as the back cloth piece uses a cotton yarn as the non-elastic yarn, and since the upper edge and the lower edge of the back cloth do not tend to fray and a cotton yarn is used, there are the effects that the touch to the skin is good, the wearing comfort is increased, and sweat absorption and air-permeability are high. Ordinarily, when a cotton yarn is used, it tends to be difficult to increase the knitting density, but using an elastic yarn for a half structure, it was possible to increase the shrinkage of the elastic yarn more than in a Denbigh structure. Thus, it is possible to increase the knitting density of the overall material, and to provide a material whose edges do not require hem finishing when left as cut, but still having the necessary extensibility.

Substantially the same effects could also be confirmed when using a back cloth piece made, as another embodiment of this example, the following manner: Two warp-knit fabrics were made using the same knitting structure as above, with the non-elastic yarn arranged in a 1×1 tricot structure (Denbigh structure) and the elastic yarn arranged in a half structure, and the non-elastic yarn and the elastic yarn both forming closed loops, and the knitting density in wales being 65/inch (knitting density of 65 wales per inch (2.54 cm)). The two knits were laid on top of each other such that their knitting direction was the same and bonded together with a resin, and then cut to a similar constitution and similar shape as that of the back cloth 35 shown in Example 5 and FIG. 8 and FIG. 9.

It should be noted that in this example, two pieces corresponding to the above-noted (B-1) were laminated, and it was confirmed that by using two pieces that are bonded together by a resin adhesive, the edge portions tended to fray even less than when using a single layer. It should be noted that in this example, cotton yarn was used for the non-elastic yarn of the piece corresponding to (B-1), but it is also possible to use nylon yarn or polyester yarn. In particular, when a nylon yarn or a polyester yarn with a thickness of at least 55 dtex is used as the non-elastic yarn, then knitting the elastic yarn as described above to a half structure increases the knitting density of the knitted fabric, and it can be prevented that the edges not requiring hem finishing when left as cut fray easily, which is preferable.

It should be noted that this use of laminates of two knitted fabrics for pieces forming a garment is not limited to the back cloths of brassieres, and is also possible for making bottoms such as short panties and girdles, lingerie and underwear.

EXAMPLE 7

A brassiere was fabricated in substantially the same manner as in Example 4. What is different to Example 4 is mainly that when the two pieces forming the back cloth are laminated by bonding together with a thermobonding resin in order to increase the strength of the back cloth, a piece made by laminating together a total of two pieces, namely one piece corresponding to the above-mentioned (A-1) and one piece corresponding to the above-mentioned (B-1), such that the piece corresponding to (B-1) is formed on the skin side, was used.

Unless indicated otherwise, other aspects are similar to Example 4 and FIG. 7, so that duplicate explanations for like aspects have been omitted.

As the piece corresponding to the above-noted (A-1) of the piece forming the back cloth, a warp-knitted fabric with a knitting density of 75 wales per inch (2.54 cm) was used that was knitted with a nylon yarn of 44 dtex as the non-elastic yarn and a polyurethane yarn of 78 dtex as the elastic yarn (the usage ratio was 65 wt % nylon yarn and 35 wt % polyurethane yarn), the non-elastic yarn and the elastic yarn running in the same direction arranged in a 1×1 tricot structure, and both the non-elastic yarn and the elastic yarn forming closed loops. As the piece corresponding to the above-noted (B-1) of the piece forming the back cloth, a warp-knitted fabric with a knitting density in wales of 60/inch (knitting density of 60 wales per inch (2.54 cm)) was used that was knitted with a cotton yarn with a yarn number of 80 as the non-elastic yarn and a polyurethane yarn of 78 dtex as the elastic yarn (the usage ratio was 65 wt % cotton and 35 wt % polyurethane), the non-elastic yarn arranged in a 1×1 tricot structure (Denbigh structure) and the elastic yarn arranged in a half structure, and the non-elastic yarn and the elastic yarn both forming closed loops, as shown in FIG. 12 and FIG. 13. The two knits were laid on top of each other such that their knitting direction was the same and bonded together with a resin, and then cut to a similar constitution and similar shape as that of the back cloth 26 shown in FIG. 7.

In the back cloths of conventional brassieres, a rubber tape is provided along the upper and lower edges of the back cloth 26, but no rubber tape is sewn to the upper and lower edges of the back cloth 26 of the brassiere of the present embodiment, so that there is no increase in thickness due to any rubber tape, a clear-cut silhouette around the bust is achieved when wearing, and there are also no wear marks from a rubber tape left on the skin. Consequently, the back cloth fits the body, and the edge portions fit the body closely without curling, displacements when moving are reduced to a minimum, preventing the garment from becoming loose.

Since the back cloth is made of two knitted fabrics that are laminated together, the tear strength is large, and the upper edge and the lower edge of the back cloth do not require hem finishing, the back cloth is made of a vertically continuous cloth, the surface is flat and without level differences from the upper edge to the lower edge, and there is no partial pressure when wearing. The knitted fabric used for the back cloth piece is a cloth whose cut edge portions do not easily fray, and since it is cut to a shape and angle at which the edge portions do not fray, the cut ends of the upper and lower edge portions are neat, and yarn ends do not protrude from them. Moreover, the knitted fabric corresponding to (B-1) used for the back cloth piece uses a cotton yarn as the non-elastic yarn, and since the upper edge and the lower edge of the back cloth do not tend to fray and the fabric corresponding to (B-1), which uses a cotton yarn, is arranged on the skin side, there are the effects that the touch to the skin is good, the wearing comfort is increased, and sweat absorption is high. Ordinarily, when a cotton yarn is used, it tends to be difficult to increase the knitting density, but using an elastic yarn for a half structure, it was possible to increase the shrinkage of the elastic yarn more than in a Denbigh structure. Thus, it is possible to increase the knitting density of the overall material, and to provide a material whose edges do not require hem finishing when left as cut, but still having the necessary extensibility.

As another embodiment of this example, it was confirmed that similar effects could also be attained when using a back cloth piece obtained as follows: A warp-knitted fabric with a knitting density of 75 wales per inch (2.54 cm) and with the same knitting structure as above was used as the piece corresponding to the above-noted (A-1). This warp-knitted fabric was knitted with a nylon yarn of 44 dtex as the non-elastic yarn and a polyurethane yarn of 78 dtex as the elastic yarn (the usage ratio was 65 wt % nylon yarn and 35 wt % polyurethane yarn), the non-elastic yarn and the elastic yarn running in the same direction forming a 1×1 tricot structure, and both the non-elastic yarn and the elastic yarn forming closed loops. As the knitted fabric corresponding to the above-noted (B-1), a warp-knitted fabric with a knitting density in wales of 60/inch (knitting density of 60 wales per inch (2.54 cm)) was used that was knitted with a cotton yarn with a yarn number of 80 as the non-elastic yarn and a polyurethane yarn of 78 dtex as the elastic yarn (the usage ratio was 65 wt % cotton and 35 wt % polyurethane), the non-elastic yarn arranged in a 1×1 tricot structure (Denbigh structure) and the elastic yarn arranged in a half structure, and the non-elastic yarn and the elastic yarn both forming closed loops. The two knits were laid on top of each other such that their knitting direction was the same and bonded together with a resin, and then cut to a similar constitution and similar shape as that of the back cloth 35 shown in Example 5 and FIGS. 8 and 9.

It should be noted that in the above example, a piece corresponding to (A-1) was used as the piece laid over and laminated to the piece corresponding to (B-1), but as mentioned above, it is also possible to use a piece corresponding to (A-2) instead of a piece corresponding to (A-1).

It should be noted that this use of laminates of two knitted fabrics for pieces forming a garment is not limited to the back cloths of brassieres, and is also possible for making bottoms such as short panties and girdles, lingerie and underwear.

EXAMPLE 8

A brassiere was fabricated in substantially the same manner as in Example 4. What is different to Example 4 is mainly that when the two pieces forming the back cloth are laminated by bonding together with a thermobonding resin in order to increase strength of the back cloth, a piece made by laminating together a total of two pieces, namely one piece corresponding to the above-mentioned (A-1) and one piece corresponding to the above-mentioned (B-2), such that the piece corresponding to (B-2) is formed on the skin side.

Unless indicated otherwise, other aspects are similar to Example 4 and FIG. 7, so that duplicate explanations for like aspects have been omitted.

As the piece corresponding to the above-noted (A-1) of the piece forming the back cloth, a warp-knitted fabric with a knitting density of 75 wales per inch (2.54 cm) was used that was knitted with a nylon yarn of 44 dtex as the non-elastic yarn and a polyurethane yarn of 78 dtex as the elastic yarn (the usage ratio was 65 wt % nylon yarn and 35 wt % polyurethane yarn), the non-elastic yarn and the elastic yarn running in the same direction forming a 1×1 tricot structure, and both the non-elastic yarn and the elastic yarn forming closed loops. As the piece corresponding to the above-noted (B-2) of the piece forming the back cloth, a knitted fabric with a knitting density in wales of 70/inch (knitting density of 70 wales per inch (2.54 cm)) was used that was knitted with a nylon yarn of 44 dtex as the non-elastic yarn and a polyurethane yarn of 78 dtex as the elastic yarn (the usage ratio was 65 wt % cotton and 35 wt % polyurethane), the non-elastic yarn arranged in a 1×1 tricot structure (Denbigh structure) and the elastic yarn arranged in an atlas structure (in this case, a 4-course atlas structure), as shown in FIG. 14 and FIG. 15. The two knits were laid on top of each other such that their knitting direction was the same and bonded together with a resin, and then cut to a similar constitution and similar shape as that of the back cloth 26 shown in FIG. 7.

In the back cloths of conventional brassieres, a rubber tape is provided along the upper and lower edges of the back cloth 26, but no rubber tape is sewn to the upper and lower edges of the back cloth 26 of the brassiere of the present embodiment, so that there is no increase in thickness due to any rubber tape, a clear-cut silhouette around the bust is achieved when wearing, and there are also no wear marks from a rubber tape left on the skin. Consequently, the back cloth fits the body, and the edge portions fit the body closely without curling, and displacements when moving are reduced to a minimum, preventing the garment from becoming loose.

The back cloth is made of the two above-described knitted fabrics laminated together, so that its tear strength is large. In particular when the elastic yarn is arranged in an atlas structure for the piece corresponding to (B-2), then the knitting structure is strong, the back cloth has the basic physical property that it is resistant to tear, and it does not fray easily. The upper edge and the lower edge of the back cloth of the brassiere of this example do not require hem finishing, the back cloth is made of a vertically continuous cloth, the surface is flat and without level differences from the upper edge to the lower edge, and there is no partial pressure when wearing.

If the elastic yarn is formed into an atlas structure, then the end parts tend to curl more easily than with a Denbigh structure or a half structure. To prevent curling, it is preferable that the cut end portions are cut at an angle in the range of 30° to 110° with respect to the knitting direction of the material. It is preferable that all locations that become edge portions of the garment when forming the garment are cut within this angular range. It is furthermore preferable that those locations that become edge portions of the garment and that are cut with a long edge length are cut in an angular range of 40° to 90°. It is even more preferable that all locations that become edge portions of the garment can be cut within an angular range of 40° to 90°.

When locations that cannot be cut in an angular range of 40° to 90° or 30° to 110° are cut to a wave-shape of a plurality of continuous arcs, then they do not tend to fray.

As another embodiment of this example, it was confirmed that similar effects could also be attained when using a back cloth piece obtained as follows: A warp-knitted fabric with a knitting density of 75 wales per inch (2.54 cm) and with the same knitting structure as above was used as the piece corresponding to the above-noted (A-1). This warp-knitted fabric was knitted with a nylon yarn of 44 dtex as the non-elastic yarn and a polyurethane yarn of 78 dtex as the elastic yarn (the usage ratio was 65 wt % nylon yarn and 35 wt % polyurethane yarn), the non-elastic yarn and the elastic yarn running in the same direction and forming a 1×1 tricot structure, and both the non-elastic yarn and the elastic yarn forming closed loops. As the piece corresponding to the above-noted (B-2) of the piece forming the back cloth, a warp-knitted fabric with a knitting density in wales of 70/inch (knitting density of 70 wales per inch (2.54 cm)) was used that was knitted with a nylon yarn of 44 dtex as the non-elastic yarn and a polyurethane yarn of 44 dtex as the elastic yarn (the usage ratio was 65 wt % cotton and 35 wt % polyurethane), the non-elastic yarn arranged in a 1×1 tricot structure (Denbigh structure) and the elastic yarn arranged in an atlas structure (in this case, a 4-course atlas structure), as shown in FIG. 14 and FIG. 15. The two knits were laid on top of each other such that their knitting direction was the same and bonded together with a resin, and then cut to a similar constitution and similar shape as that of the back cloth 35 shown in Example 5 and FIGS. 8 and 9.

It should be noted that in the above example, a piece corresponding to (B-2) was used as the piece laid over and laminated to the piece corresponding to (A-1), but as mentioned above, it is also possible to use a piece corresponding to (A-2) instead of a piece corresponding to (A-1), and it is also possible to use a piece corresponding to (B-1) instead of a piece corresponding to (B-2).

It should be noted that this use of laminates of two knitted fabrics for pieces forming a garment is not limited to the back cloths of brassieres, and is also possible for making bottoms such as short panties and girdles, lingerie and underwear.

EXAMPLE 9

Figure 20:
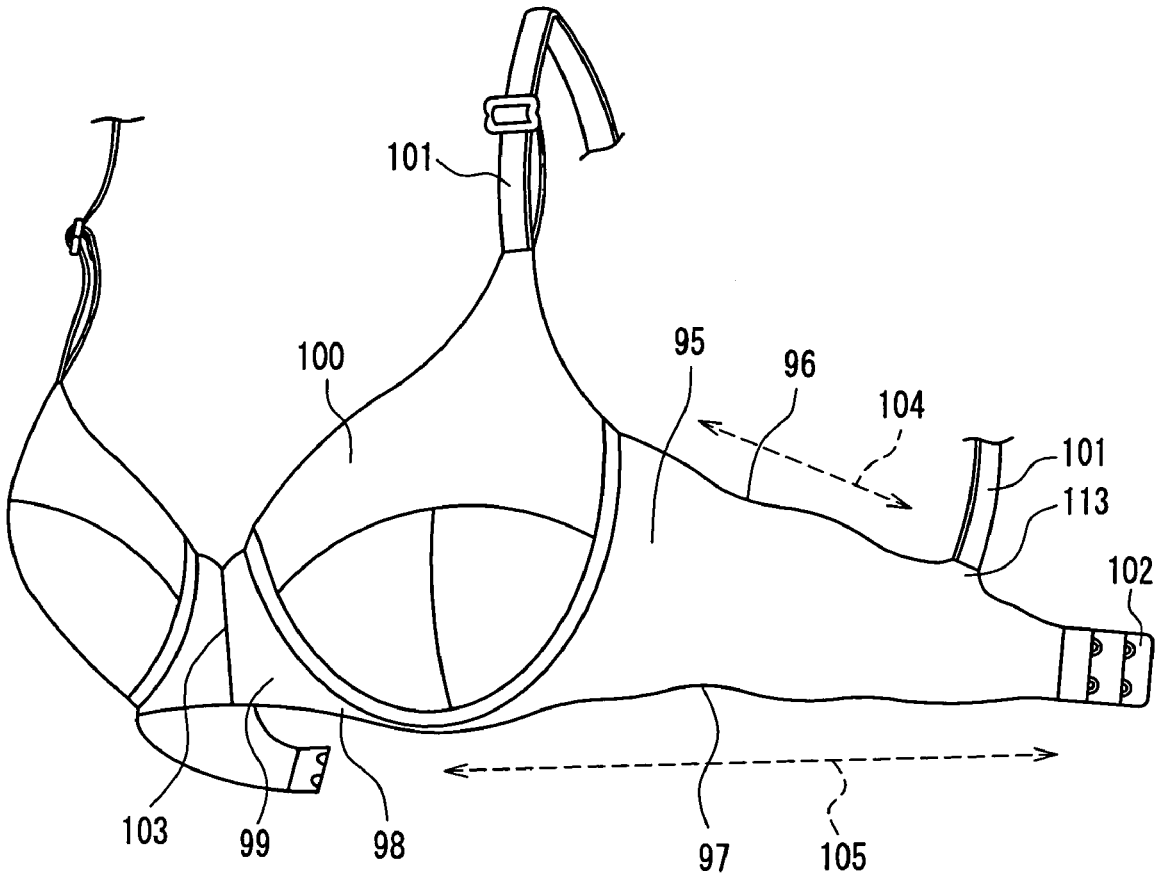
FIG. 20 is a perspective view of the principal portions of a brassiere according to an embodiment of the present invention of a garment having an edge that does not require hem finishing when left as cut.
Figure 21:
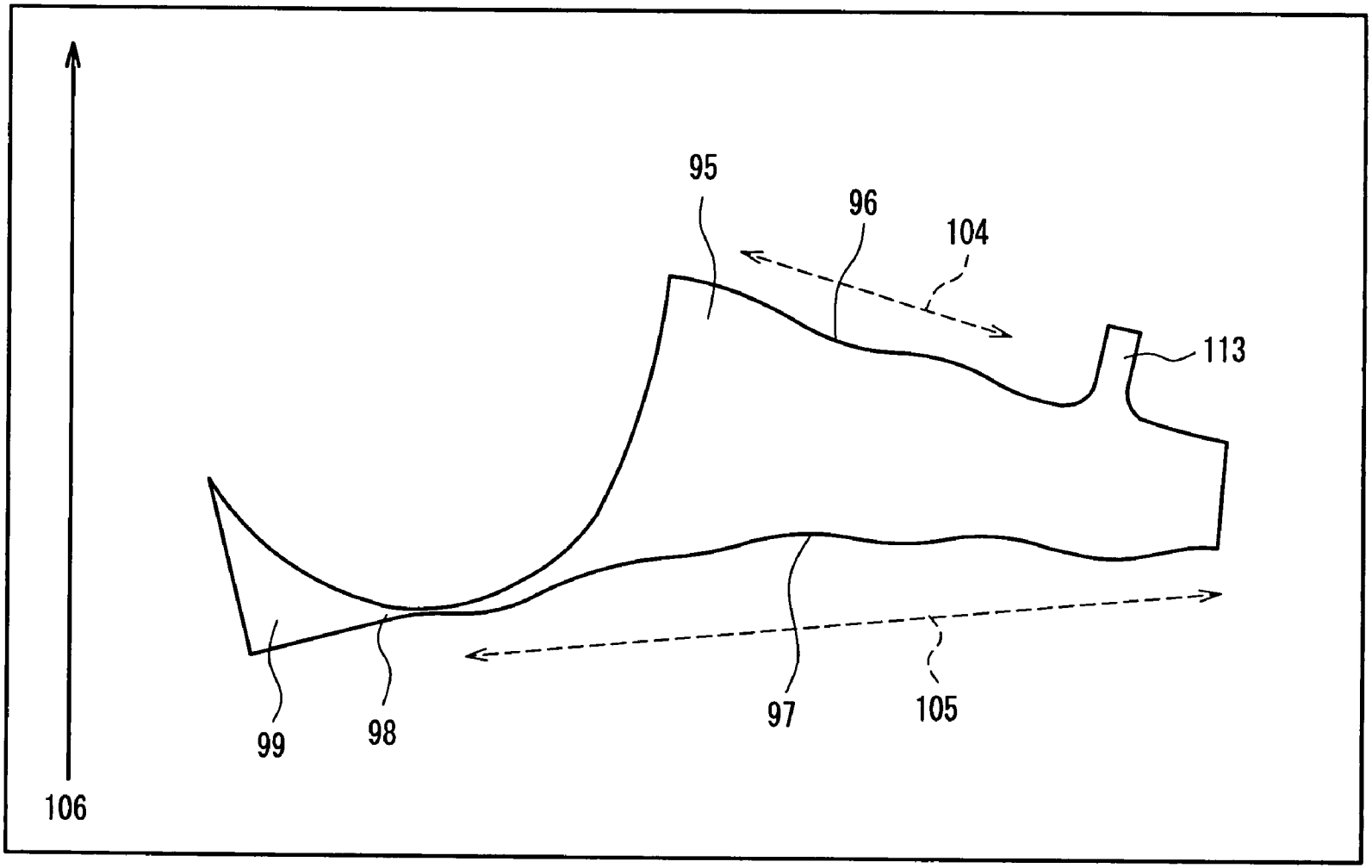
FIG. 21 is a plane view showing, on a knitted fabric, a cutting line of a back cloth piece 95, corresponding to the left side of the wearer of the brassiere shown in FIG. 20.

FIG. 20 is a perspective view of the principal portions of a brassiere according to an embodiment of the present invention of a garment having an edge that does not require hem finishing when left as cut. FIG. 21 is a plane view showing, on a knitted fabric, a cutting line of a back cloth piece 95, corresponding to the left side of the wearer of the brassiere shown in FIG. 20. In FIG. 20, reference numeral 95 denotes a stretchable back cloth, reference numeral 98 denotes an under-cup portion, reference numeral 99 denotes a front center portion, reference numeral 102 denotes a linking portion for linking the left and right back cloth when wearing the brassiere, reference numeral 100 denotes a breast cup, reference numeral 101 denotes a strap, and reference numeral 103 denotes the location where the left and right front center portions are sewn together. The back cloth portion, the under-cup portion and the front center portion are made of one continuous piece of cloth. The stretchable back cloth 95 is a piece that does not require hem finishing when left as cut, and is formed using a cloth that is continuous in the vertical direction. The knitting direction of the warp-knitted fabric constituting this piece is the direction indicated by arrow 106 (see FIG. 21).

This back cloth portion 95 uses two pieces forming the back cloth that are laminated by bonding together with a thermobonding resin in order to increase strength of the back cloth, namely one piece corresponding to (A-1) and one piece corresponding to (B-1), such that the piece corresponding to (B-1) is formed on the skin side.

As the piece corresponding to the above-noted (A-1) of the piece forming the back cloth, a warp-knitted fabric with a knitting density of 75 wales per inch (2.54 cm) was used that was knitted with a nylon yarn of 44 dtex as the non-elastic yarn and a polyurethane yarn of 78 dtex as the elastic yarn, the non-elastic yarn and the elastic yarn running in the same direction forming a 1×1 tricot structure, and both the non-elastic yarn and the elastic yarn forming closed loops. As the piece corresponding to the above-noted (B-1) of the piece forming the back cloth, a warp-knitted fabric with a knitting density in wales of 75/inch (knitting density of 75 wales per inch (2.54 cm)) was used that was knitted with a cotton yarn with a yarn number of 80 as the non-elastic yarn and a polyurethane yarn of 78 dtex as the elastic yarn (the usage ratio was 65 wt % cotton and 35 wt % polyurethane), the non-elastic yarn arranged in a 1×1 tricot structure (Denbigh structure) and the elastic yarn arranged in a half structure, and the non-elastic yarn and the elastic yarn both forming closed loops, as shown in FIG. 12 and FIG. 13. The two knits were laid on top of each other such that their knitting direction was the same and bonded together with a resin, and then cut to the shape of the back cloth 95 shown in FIG. 21.

The edges of the back cloth 95 that do not require hem finishing when left as cut are the portions of the edge 97 on the lower side of the back cloth (abbreviated as "lower edge") and the edge 96 on the upper side of the back cloth (abbreviated as "upper edge"). Both the lower edge 97 and the upper edge 96 are formed by wave shapes of a plurality of waves.

In the upper edge 96 and the lower edge 97 of the back cloth, concave and convex portions of the wave shape appear at substantially the same intervals. Where the wave shape of the upper edge 96 has an upward-pointing convex portion, the wave shape of the lower edge 97 has a downward-pointing convex portion, and conversely, where the wave shape of the upper edge has a downward-pointing convex portion (upward-pointing concave portion), the wave shape of the lower edge 97 has an upward-pointing convex portion (downward-pointing concave portion). Thus, the convex and concave portions at the upper edge and the lower edge of the back cloth are substantially symmetric with the line bisecting the back cloth in upper half and lower half. Moreover, the curved shape of the individual waves of the wave shape formed in the back cloth is a gentle curve (a curve with a large curvature radius), and forms a gentle wave shape with a long wavelength and little height differences in the wave shape. In other words, its shape is like that of a peapod. By making the wave shape a gentle wave shape with a long wavelength and little height differences in the wave shape, the back cloth's body fit properties are improved, overturning of the upper and lower edge portions is prevented, and it can be prevented that tear from the trough portions of the wave shape in particular occurs easily.

Moreover, ignoring the convex and concave portions of the individual wave shapes, the upper edge 96 of the back cloth 95 forms a gentle curve that on the whole protrudes downward, and in this gentle curve portion, there is a gently wave-shaped curve portion, whereas ignoring the convex and concave portions of the individual wave shapes, the lower edge 97 of the back cloth 95 forms a gentle curve that on the whole protrudes upward, and in this gentle curve portion, there are four gently wave-shaped curve portions.

Consequently, the direction of the edge line of the edge 97 on the lower side of the back cloth 95 has on the whole a curved shape, so that it has the same direction as the straight line connecting the end of the lower edge 97 of the back cloth that is closer to the breast cup and the end that is close to the linking portion 102, that is, the direction shown by the arrow 105, and forms an angle (cutting angle) of 85° with respect to the knitting direction. The direction of the edge line of the edge 96 on the upper side of is the same direction as the straight line connecting the crests of this wave shape, that is, the direction indicated by arrow 104, and forms an angle of 105° (cutting angle) with the knitting direction. That is to say, the lines constituting the upper and lower edges of the back cloth, which do not require hem finishing when left as cut, are not parallel to one another. It should be noted that since the edge lines are wave-shaped, the wave-shaped portions of the edge line of the lower edge 97 are cut at an angle that surpasses and falls below 85° and the wave-shaped portions of the edge line of the upper edge 96 are cut at an angle that surpasses and falls below 105°. The under-cup portion 98 and the front center portion 99 are cut at an angle of substantially 75° with respect to the knitting direction.

Reference numeral 113 denotes a strap attachment location. A strap 101 is attached to the end of this strap attachment location 113. The strap attachment location 113 is continuous with the back cloth 95, and is cut in one piece with the back cloth. Its edge portion is left as cut and does not require hem finishing. The broadest width of the back cloth 95 is set to 9 cm and the narrowest width is set to 4 cm.

In the back cloths of conventional brassieres, a rubber tape is provided along the upper and lower edges of the back cloth 95, but no rubber tape is sewn to the upper and lower edges of the back cloth 95 of the brassiere of the present embodiment, so that there is no increase in thickness due to any rubber tape, a clear-cut silhouette around the bust is achieved when wearing, and there are also no wear marks from a rubber tape left on the skin. Consequently, the back cloth fits the body, and displacements occurring when moving are reduced to a minimum, preventing the garment from becoming loose. Moreover, it can be effectively prevented that the edge portion of the back cloth turns over.

Since the back cloth is made of two knitted fabrics that are laminated together, the tear strength is large, the upper edge and the lower edge of the back cloth do not require hem finishing, the back cloth is made of a vertically continuous cloth, the surface is flat and without level differences from the upper edge to the lower edge, and there is no partial pressure when wearing. The knitted fabric used for the back cloth piece is a cloth whose cut edge portions do not easily fray, and since it is cut to a shape and angle at which the edge portions do not fray, the cut ends of the upper and lower edge portions are neat, and yarn ends do not protrude from them. Moreover, the knitted fabric corresponding to (B-1) used for the back cloth piece uses a cotton yarn as the non-elastic yarn, and since the upper edge and the lower edge of the back cloth do not tend to fray and the fabric corresponding to (B-1), which uses a cotton yarn, is arranged on the skin side, there are the effects that the touch to the skin is good, the wearing comfort is increased, and sweat absorption is high. Ordinarily, when a cotton yarn is used, it tends to be difficult to increase the knitting density, but using a half structure for the elastic yarn, it was possible to increase the shrinkage of the elastic yarn more than in a Denbigh structure. Thus, it is possible to increase the knitting density of the overall material, and to provide a material whose edges do not require hem finishing when left as cut, but still having the necessary extensibility.

It should be noted that in the above example, a piece corresponding to (A-1) was used as the piece laid over and laminated to the piece corresponding to (B-1), but as mentioned above, it is also possible to use a piece corresponding to (A-2) instead of the piece corresponding to (A-1). Furthermore, instead of the cotton yarn of the piece corresponding to (B-1), it is also possible to use another non-elastic yarn, such as nylon yarn or polyester yarn.

It should be noted that this use of laminates of two knitted fabrics for pieces forming a garment is not limited to the back cloths of brassieres, and is also possible for making bottoms such as short panties and girdles, lingerie and underwear.

The knitting density (in wales), the runner of the non-elastic yarn and the runner of the elastic yarn of the warp-knitted fabric used for the pieces of the foregoing examples are listed in Table 1 below.

EXAMPLE 10

Figure 22:
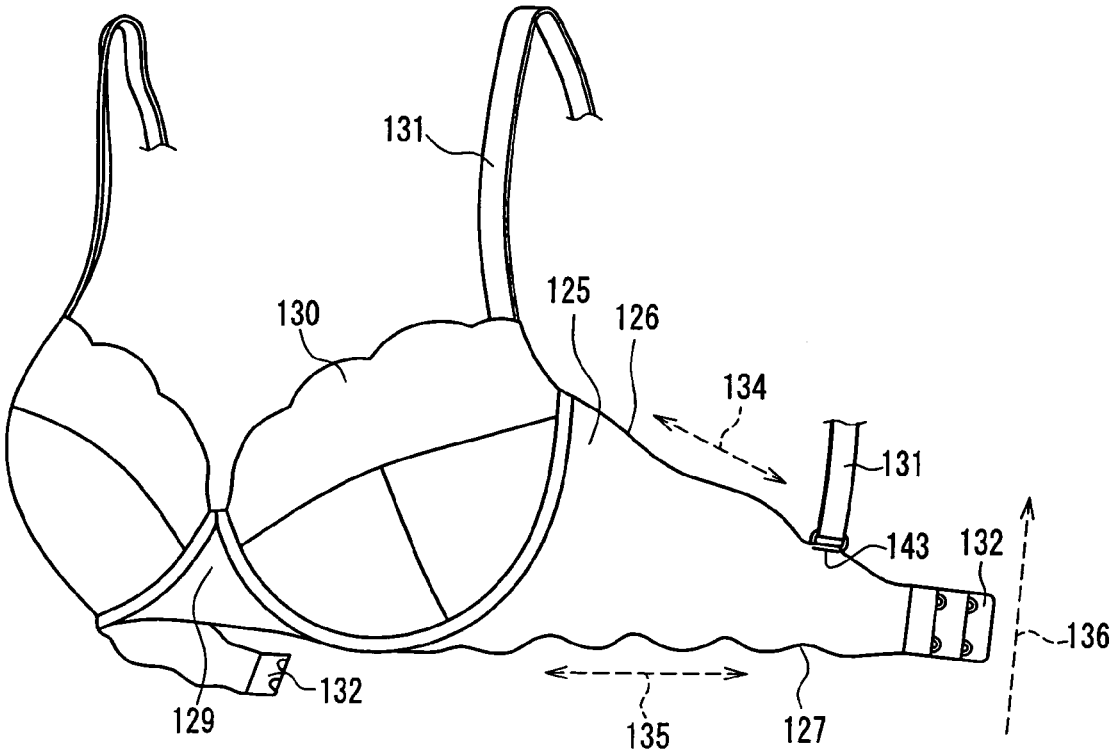
FIG. 22 is a perspective view of the principal portions of a brassiere according to an embodiment of the present invention of a garment having an edge that does not require hem finishing when left as cut.

FIG. 22 is a perspective view of the principal portions of a brassiere according to an embodiment of the present invention of a garment having an edge that does not require hem finishing when left as cut. In this example, a plane view showing, on the knitted fabric, the cutting lines of the back cloth piece corresponding to the left side of the wearer of a brassiere as shown for FIG. 20 has been omitted. Its shape is slightly different, but it has substantially the same knitting direction and directions of the edge lines.

In FIG. 22, reference numeral 130 denotes a breast cup, reference numeral 125 denotes a stretchable back cloth, reference numeral 129 denotes a front center cloth linking the left and right breast cups, reference numeral 132 denotes linking portions for linking the left and right back cloths when wearing the brassiere, and reference numeral 131 denotes a strap. The stretchable back cloth 125 comprises a piece that does not require hem finishing when left as cut, and is formed using a cloth that is continuous in the vertical direction. The knitting direction of the warp-knitted fabric constituting this piece is the direction indicated by arrow 136.

This back cloth portion 125 uses two pieces forming the back cloth that are laminated by bonding together with a thermobonding resin in order to increase the strength of the back cloth, namely one piece corresponding to (A-1) and one piece corresponding to (B-1), such that the piece corresponding to (B-1) is formed on the skin side.

As the piece corresponding to the above-noted (A-1) of the piece forming the back cloth, a warp-knitted fabric with a knitting density of 75 wales per inch (2.54 cm) was used that was knitted with a nylon yarn of 44 dtex as the non-elastic yarn and a polyurethane yarn of 78 dtex as the elastic yarn, the non-elastic yarn and the elastic yarn running in the same direction forming a 1×1 tricot structure, and both the non-elastic yarn and the elastic yarn forming closed loops. As the piece corresponding to the above-noted (B-1) of the piece forming the back cloth, a warp-knitted fabric with a knitting density in wales of 75/inch (knitting density of 75 wales per inch (2.54 cm)) was used that was knitted with a cotton yarn with a yarn number of 80 as the non-elastic yarn and a polyurethane yarn of 78 dtex as the elastic yarn (the usage ratio was 65 wt % cotton and 35 wt % polyurethane), the non-elastic yarn arranged in a 1×1 tricot structure (Denbigh structure) and the elastic yarn arranged in a half structure, and the non-elastic yarn and the elastic yarn both forming closed loops, as shown in FIG. 12 and FIG. 13. The two knits were laid on top of each other such that their knitting direction was the same and bonded together with a resin, and then cut to the shape of the back cloth.

The edges of the back cloth 125 that do not require hem finishing when left as cut are the portions of the edge 127 on the lower side of the back cloth (abbreviated as "lower edge") and the edge 126 on the upper side of the back cloth (abbreviated as "upper edge"). Both the lower edge 127 and the upper edge 126 are formed by wave shapes of a plurality of waves.

In the example of this embodiment, the wave shape of the upper edge 126 and the wave shape of the lower edge 127 of the back cloth are different. The wave shape of the upper edge 126 has three convexly shaped portions pointing upward, whereas the wave shape of the lower edge 127 has five convexly shaped portions pointing downward, so that the number of waves is different. In this example, the number of waves of the upper edge 126 is smaller than the number of waves of the lower edge 126, but this may also be opposite to the above. Also the height of the wave shapes (corresponding to the wave amplitude) in the upper edge 126 and the lower edge 127 is different. The upper edge 126 has a wave shape of low height, and the lower edge 127 has a wave shape whose height is higher than that of the upper edge 126. It should be noted that the height of the wave shapes of the upper edge 126 and the lower edge 127.

It is preferable that the height of the waves in the edge having fewer wave shapes is low, whereas the height of the waves in the edge having more wave shapes is high. With this embodiment, curling at the respective edges tends to occur even less. Also, even when the design of the upper edge 126 and the lower edge 127 differs in this manner, it is possible to strike a balance between the stresses acting on the upper edge and the lower edge of the back cloth more easily.

Moreover, ignoring the convex and concave portions of the individual wave shapes, the upper edge 126 of the back cloth 125 forms a gentle curve that on the whole protrudes downward, and in this gentle curve portion, there are several wave shaped curve portions, and ignoring the convex and concave portions of the individual wave shapes, the lower edge 127 of the back cloth 125 forms a gentle curve that on the whole protrudes upward, and in this gentle curve portion, there are several wave shaped curve portions.

Consequently, the direction of the edge line of the edge 127 on the lower side of the back cloth 125 has on the whole a curved shape, so that it has the same direction as the straight line connecting the end of the lower edge 127 of the back cloth that is closer to the breast cup and the end that is close to the linking portion 132, that is, the direction shown by the arrow 135, and forms an angle (cutting angle) of 85° with respect to the knitting direction 136. The direction of the edge line of the upper edge of the back cloth 126 is the same direction as the straight line connecting the crests of this wave shape, that is, the direction indicated by arrow 134, and forms an angle of 105° (cutting angle) with the knitting direction 136. That is to say, the lines constituting the upper and lower edges of the back cloth, which do not require hem finishing when left as cut, are not parallel to one another. It should be noted that since the edge lines are wave-shaped, the wave-shaped portions of the edge line of the lower edge 127 are cut at an angle that surpasses and falls below 850 and the wave-shaped portions of the edge line of the upper edge 126 are cut at an angle that surpasses and falls below 105°. The edge on the lower side of the front center portion 129 is cut at an angle of substantially 75° with respect to the knitting direction.

Reference numeral 143 denotes a strap attachment location. A strap 131 is attached to the end of this strap attachment location 143. Although not shown in the drawings, the strap attachment location 143 is continuous with the back cloth 125, similar to the case indicated by reference numeral 113 in FIG. 21, and is cut in one piece with the back cloth. Its edge portion is left as cut and does not require hem finishing. The broadest width of the back cloth 125 is set to 9 cm and the narrowest width is set to 4 cm.

In the back cloths of conventional brassieres, a rubber tape is provided along the upper and lower edges of the back cloth 125, but no rubber tape is sewn to the upper and lower edges of the back cloth 125 of the brassiere of the present embodiment, so that there is no increase in thickness due to any rubber tape, a clear-cut silhouette around the bust is achieved when wearing, and there are also no wear marks from a rubber tape left on the skin. Consequently, the back cloth fits the body, and displacements occurring when moving are reduced to a minimum, preventing the garment from becoming loose. Moreover, it can be effectively prevented that the edge portion of the back cloth turns over.

Since the back cloth is made of two knitted fabrics that are laminated together, the tear strength is large, the upper edge and the lower edge of the back cloth do not require hem finishing, the back cloth is made of a vertically continuous cloth, the surface is flat and without level differences from the upper edge to the lower edge, and there is no partial pressure when wearing. The knitted fabric used for the back cloth piece is a cloth whose cut edge portions do not easily fray, and since it is cut to a shape and angle at which the edge portions do not fray, the cut ends of the upper and lower edge portions are neat, and yarn ends do not protrude from them. Moreover, the knitted fabric corresponding to (B-1) used for the back cloth piece uses a cotton yarn as the non-elastic yarn, and since the upper edge and the lower edge of the back cloth do not tend to fray and the fabric corresponding to (B-1), which uses a cotton yarn, is arranged on the skin side, there are the effects that the touch to the skin is good, the wearing comfort is increased, and sweat absorption is high. Ordinarily, when a cotton yarn is used, it tends to be difficult to increase the knitting density, but using a half structure for the elastic yarn, it was possible to increase the shrinkage of the elastic yarn more than in a Denbigh structure. Thus, it is possible to increase the knitting density of the overall material, and to provide a material whose edges do not require hem finishing when left as cut, but still having the necessary extensibility.

It should be noted that in the above example, a piece corresponding to (A-1) was used as the piece laid over and laminated to a piece corresponding to (B-1), but as mentioned above, it is also possible to use a piece corresponding to (A-2) instead of the piece corresponding to (A-1). Furthermore, instead of the cotton yarn of the piece corresponding to (B-1), it is also possible to use another non-elastic yarn, such as nylon yarn or polyester yarn.

It should be noted that this use of laminates of two knitted fabrics for pieces forming a garment is not limited to the back cloths of brassieres, and is also possible for making bottoms such as short panties and girdles, lingerie and underwear.

The knitting density (in wales), the runner of the non-elastic yarn and the runner of the elastic yarn of the warp-knitted fabric used for the pieces of the foregoing examples are listed in Table 1 below.

TABLE 1

| Ex. No. | piece name | knitting density (wales/2.5 4 cm) | A runner of non-elastic yarn (cm/rack) | B runner of elastic yarn (cm/rack) | A/B |
|---|---|---|---|---|---|
| 1 | hip piece 1 | 70 | 99 | 70 | 1.414 |
| 1 | abdomen piece 6 | 68 | 102 | 77 | 1.325 |
| 2 | hip piece 15 | 70 | 99 | 70 | 1.414 |
| 2 | front center bottom piece 17 | 70 | 99 | 70 | 1.414 |
| 2 | abdomen piece 16 | 65 | 96 | 77 | 1.247 |
| 3 | hip piece 75 and abdomen piece 76 | 63 | base knitted portion 106 | base knitted portion 72 | base knitted portion 1.472 |
| 4 | back cloth 26 | 63 | 110 | 95 | 1.158 |
| 5 | back cloth 35 | 63 | 110 | 95 | 1.158 |
| 6 | back cloth | 65 | 98 | 90 | 1.089 |
| 7 | back cloth corresponding to (A-1) | 75 | 110 | 95 | 1.158 |
| 7 | back cloth corresponding to (B-1) | 60 | 98 | 90 | 1.089 |
| 8 | back cloth corresponding to (A-1) | 75 | 110 | 95 | 1.158 |
| 8 | back cloth corresponding to (B-2) | 70 | 110 | 95 | 1.158 |
| 9 | back cloth corresponding to (A-1) | 75 | 110 | 95 | 1.158 |
| 9 | back cloth corresponding to (B-1) | 75 | 98 | 90 | 1.089 |
| 10 | back cloth | 75 | 110 | 95 | 1.158 |

TABLE 1-continued

| Ex. No. | piece name | knitting density (wales/2.5 4 cm) | A runner of non-elastic yarn (cm/rack) | B runner of elastic yarn (cm/rack) | A/B |
|---|---|---|---|---|---|
| 10 | corresponding to (A-1) back cloth corresponding to (B-1) | 75 | 98 | 90 | 1.089 |

INDUSTRIAL APPLICABILITY

The garment of the present invention is formed from a piece of cloth that does not require hem finishing when left as cut, so that a garment can be provided that does not require edges hem finishing, in which level differences reflecting the bottom line or the waist line on an outer garment are not apparent, and the portion of the edge does not become thick. Moreover, either the upper or the lower or both edge portions of the garment may be edges that do not require hem finishing, the degree of freedom of design of the garment can be increased, the garment fits the body without curling of the garment's edge portions, the garment has stretchability and high wearing comfort. Consequently, the present invention is useful for garments that are worn tightly fitting the body, for example bottom garments such as girdles or shorts, for brassieres or tops of bathing suits or leotards, or the like in which the present invention is applied to the back cloth.

The invention claimed is:

1. A garment comprising:

a piece of a stretchable warp-knitted fabric comprising:

a non-elastic yarn arranged in a 1×1 tricot structure; and an elastic yarn arranged in a looping structure, wherein at least one of an upper garment edge and a lower garment edge of the piece is an edge without hem finishing when left as cut; and wherein the piece is cut at an angle of at least 3° and at most 177° with respect to a knitting direction, and the piece having an edge without hem finishing when left as cut, so that at least one of an edge portion of the garment is formed by an edge without hem finishing when left as cut.

2. The garment according to claim 1, wherein the warp-knitted fabric comprises a 1×1 tricot structure in which the non-elastic yarn and the elastic yarn run in the same direction, and both the elastic yarn and the non-elastic yarn form open loops.

3. The garment according to claim 1, wherein the warp-knitted fabric comprises a 1×1 tricot structure in which the non-elastic yarn and the elastic yarn run in different directions, and at least one of the elastic yarn and the non-elastic yarn forms closed loops.

4. The garment according to claim 1, wherein the warp-knitted fabric comprises a 1×1 tricot structure in which the non-elastic yarn and the elastic yarn run in different directions, and both the elastic yarn and the non-elastic yarn forms closed loops.

5. The garment according to claim 1, wherein a structure of the elastic yarn is at least one of a half structure and an atlas structure.

6. The garment according to claim 5 wherein at least one of the elastic yarn and the non-elastic yarn forms closed loops.

7. The garment according to claim 5 wherein both of the elastic yarn and the non-elastic yarn form closed loops.

8. The garment according to claim 5, wherein the non-elastic yarn is a cotton yarn.

9. The garment according to claim 5, wherein the non-elastic yarn is a cotton yarn, and at least one of the elastic yarn and the non-elastic yarn forms closed loops.

10. The garment according to claim 5, wherein the non-elastic yarn is a cotton yarn, and both of the elastic yarn and the non-elastic yarn form closed loops.

11. The garment according to claim 1, wherein the piece is a laminated piece laminated by bonding at least one material selected from a group consisting of (A-1) and (A-2) to a cloth other than (A-1) and (A-2), wherein (A-1) is a warp-knitted fabric wherein both the non-elastic yarn and the elastic yarn are arranged in a 1×1 tricot structure and run in the same direction, and both the elastic yarn and the non-elastic yarn form closed loops;

wherein (A-2) is a warp-knitted fabric wherein both the non-elastic yarn and the elastic yarn are arranged in a 1×1 tricot structure and run in the same direction, and one of the elastic yarn and the non-elastic yarn forms closed loops and the other one forms open loops.

12. The garment according to claim 11, wherein the said other cloth is selected from a group consisting of(B-1), (B-2), (B-3) and (B-4), wherein (B-1) is a warp-knitted fabric wherein the non-elastic yarn is arranged in a 1×1 tricot structure and the elastic yarn is arranged in a half structure;

wherein (B-2) is a warp-knitted fabric wherein the non-elastic yarn is arranged in a 1×1 tricot structure and the elastic yarn is arranged in an atlas structure;

wherein (B-3) is a warp-knitted fabric wherein both the non-elastic yarn and the elastic yarn are arranged in a 1×1 tricot structure and run in the same direction, and both the non-elastic yarn and the elastic yarn form open loops;

wherein (B-4) is a warp-knitted fabric wherein the non-elastic yarn and the elastic yarn run in different directions, and both the non-elastic yarn and the elastic yarn are arranged in a 1×1 tricot structure and form closed loops.

13. The garment according to claim 1, wherein the piece is a laminated piece laminated by bonding together a plurality of sheets of at least one cloth selected from a group consisting of(B-1), (B-2), (B-3) and (B-4), wherein (B-1) is a warp-knitted fabric wherein the non-elastic yarn is arranged in a 1×1 tricot structure and the elastic yarn is arranged in a half structure;

wherein (B-2) is a warp-knitted fabric wherein the non-elastic yarn is arranged in a 1×1 tricot structure and the elastic yarn is arranged in an atlas structure;

wherein (B-3) is a warp-knitted fabric wherein both the non-elastic yarn and the elastic yarn are arranged in a 1×1 tricot structure and run in the same direction, and both the non-elastic yarn and the elastic yarn form open loops;

wherein (B-4) is a warp-knitted fabric wherein the non-elastic yarn and the elastic yarn run in different directions, and both the non-elastic yarn and the elastic yarn are arranged in a 1×1 tricot structure and form closed loops.

14. The garment according to claim 12, wherein the material is (A-1) and the cloth is (B-1).

15. The garment according to claim 14, wherein the non-elastic yarn of (B-1) is cotton, and both the non-elastic yarn and the elastic yarn form closed loops.

16. The garment according to claim 1, wherein the edge without hem finishing is cut at an angle of 10° to 120° with respect to the knitting direction.

17. The garment according to claim 1, wherein both the upper garment edge and the lower garment edge of the piece are edges without hem finishing when left as cut, and wherein the edges without hem finishing are cut at an angle of 10° to 120° with respect to the knitting direction.

18. The garment according to claim 1, wherein the piece is made of warp-knitted fabric that is continuous in vertical direction of the garment.

19. The garment according to claim 1, wherein at least one of an upper garment edge and a lower garment edge of the piece is an edge without hem finishing when left as cut, and the edge without hem finishing is cut in a curved line.

20. The garment according to claim 19, wherein both the upper garment edge and the lower garment edge of the piece are edges without hem finishing when left as cut, and wherein the edges without hem finishing are cut in a curved line.

21. The garment according to claim 1, wherein at least one of an upper garment edge and a lower garment edge of the piece is an edge without hem finishing when left as cut, and the edge without hem finishing has a wave shape of a plurality of curved lines.

22. The garment according to claim 1, wherein both the upper garment edge and the lower garment edge of the piece are edges without hem finishing when left as cut, and wherein the edges without hem finishing have a wave shape of a plurality of curved lines.

23. The garment according to claim 1, wherein both an upper garment edge and a lower garment edge of the piece are edges without hem finishing when left as cut, and a first line extending from the upper edge and a second line extending from the lower edge form an angle.

24. The garment according to claim 1, wherein both an upper garment edge and a lower garment edge of the piece are edges without hem finishing when left as cut, and a shape of the upper edge is different from a shape of the lower edge.

25. The garment according to claim 1, wherein the garment is a bottom garment, and the edge of the piece without hem finishing when left as cut forms at least one of a waist and a bottom line.

26. The garment according to claim 25, wherein the garment is a bottom garment, and the edges of the piece without hem finishing when left as cut form both a waist and a bottom line.

27. The garment according to claim 1, wherein the garment is at least one of a brassiere, a top of a bathing suit and a leotard, and the edge of the piece without hem finishing when left as cut forms at least one of an upper edge and a lower edge of a back cloth.

28. The garment according to claim 1, wherein the garment is at least one of a brassiere, a top of a bathing suit and a leotard, and the edges of the piece without hem finishing when left as cut form both an upper edge and a lower edge of a back cloth.

29. The garment according to claim 25, wherein the edge of the piece without hem finishing when left as cut is cut at an angle of 20° to 80° with respect to the knitting direction.

30. The garment according to claim 26, wherein the edges of the piece without hem finishing when left as cut being both cut at an angle of 20° to 80° with respect to the knitting direction.

31. The garment according to claim 27, wherein the garment edges of the piece forming the back cloth without hem finishing when left as cut being cut at an angle of 10° to 90° with respect to the knitting direction.

32. The garment according to claim 27, wherein the garment edges of the piece forming the back cloth without hem finishing when left as cut being cut at an angle of 75° to 90° with respect to the knitting direction.

33. The garment according to claim 1, wherein the piece is provided with a Jacquard pattern knitted into a base fabric made of the non-elastic yarn and the elastic yarn, by Jacquard control of another non-elastic yarn serving as a pattern yarn.

34. The garment according to claim 33, wherein the elastic yarn forming the base knit structure is arranged in a 1×1 tricot structure, and at least one of the non-elastic yarn forming the base knit structure and the non-elastic yarn serving as the Jacquard-controlled pattern yarn is arranged in a 1×1 tricot structure that runs in the same direction as the elastic yarn, and a portion forming the Jacquard pattern in the pattern yarn has a structure other than a 1×1 tricot structure.

35. The garment according to claim 33, wherein the elastic yarn forming the base knit structure is arranged in a 1×1 tricot structure, and one of the non-elastic yarn forming the base knit structure and the non-elastic yarn serving as the Jacquard-controlled pattern yarn is arranged in a 1×1 tricot structure that runs in the same direction as the elastic yarn, whereas the other non-elastic yarn is arranged in a 1×1 tricot structure and runs in a direction different to that of the elastic yarn, and a portion forming the Jacquard pattern in the pattern yarn has a structure other than a 1×1 tricot structure.

36. The garment according to claim 33, wherein the non-elastic yarn forming the base knit structure is arranged in a 1×1 tricot structure that runs in a direction that is different to that of the elastic yarn forming the base knit structure, and the non-elastic yarn serving as the Jacquard-controlled pattern yarn is arranged in a structure that runs in the same direction as the elastic yarn, and a portion forming the Jacquard pattern in the pattern yarn has a structure other than a 1×1 tricot structure.

37. The garment according to claim 33, wherein the piece is a laminated piece laminated by bonding at least one material selected from a group consisting of (A-1) and (A-2) to a material made of a piece in which the Jacquard pattern is formed, wherein (A-1) is a warp-knitted fabric wherein both the non-elastic yarn and the elastic yarn are arranged in a 1×1 tricot structure and run in the same direction, and both the elastic yarn and the non-elastic yarn form closed loops, and wherein (A-2) is a warp-knitted fabric wherein both the non-elastic yarn and the elastic yarn are arranged in a 1×11 tricot structure and run in the same direction, and one of the elastic yarn and the non-elastic yarn forms closed loops and the other one forms open loops.

38. The garment according to claim 27, wherein the back cloth comprises a laminated piece laminated by bonding at least one material selected from a group consisting of(A-1) and (A-2) to a cloth other than (A-1) and (A-2), wherein (A-1) is a warp-knitted fabric wherein both the non-elastic yarn and the elastic yarn are arranged in a 1×1 tricot structure and run in the same direction, and both the elastic yarn and the non-elastic yarn form closed loops; and wherein (A-2) is a warp-knitted fabric wherein both the non-elastic yarn and the elastic yarn are arranged in a 1×1 tricot structure and run in the same direction, and one of the elastic yarn and the non-elastic yarn forms closed loops and the other one forms open loops.

39. The garment according to claim 1, wherein the piece has a straight boundary line for a stretching power transition region due to the elastic yarn.

40. The garment according to claim 1, wherein the garment is a garment that fits a body tightly.

41. The garment according to claim 11, wherein at least one of an upper garment edge and a lower garment edge of the piece is an edge without hem finishing when left as cut, and the edge without hem finishing is cut at an angle of 10° to 120° with respect to the knitting direction.

42. The garment according to claim 11, wherein at least one of an upper garment edge and a lower garment edge of the piece is an edge without hem finishing when left as cut, and the edge without hem finishing is cut at an angle of 10° to 120° with respect to the knitting direction.

43. The garment according to claim 13, wherein at least one of an upper garment edge and a lower garment edge of the piece is an edge without hem finishing when left as cut, and the edge without hem finishing is cut at an angle of 10° to 120° with respect to the knitting direction.

44. The garment according to claim 34, wherein the piece comprises a laminated piece laminated by bonding at least one material selected from a group consisting of(A-1) and (A-2) to a material made of a piece in which the Jacquard pattern is formed, wherein (A-1) is a warp-knitted fabric wherein both the non-elastic yarn and the elastic yarn are arranged in a 1×1 tricot structure and run in the same direction, and both the elastic yarn and the non-elastic yarn form closed loops; and wherein (A-2) is a warp-knitted fabric wherein both the non-elastic yarn and the elastic yarn are arranged in a 1×1 tricot structure and run in the same direction, and one of the elastic yarn and the non-elastic yarn forms closed loops and the other one forms open loops.

45. The garment according to claim 35, wherein the piece comprises a laminated piece laminated by bonding at least one material selected from a group consisting of (A-1) and (A-2) to a material made of a piece in which the Jacquard pattern is formed, wherein (A-1) is a warp-knitted fabric wherein both the non-elastic yarn and the elastic yarn are arranged in a 1×1 tricot structure and run in the same direction, and both the elastic yarn and the non-elastic yarn form closed loops; and wherein (A-2) is a warp-knitted fabric wherein both the non-elastic yarn and the elastic yarn are arranged in a 1×1 tricot structure and run in the same direction, and one of the elastic yarn and the non-elastic yarn forms closed loops and the other one forms open loops.

46. The garment according to claim 36, wherein the piece comprises a laminated piece laminated by bonding at least one material selected from a group consisting of(A-1) and (A-2) to a material made of a piece in which the Jacquard pattern is formed, wherein (A-1) is a warp-knitted fabric wherein both the non-elastic yarn and the elastic yarn are arranged in a 1×1 tricot structure and run in the same direction, and both the elastic yarn and the non-elastic yarn form closed loop; and wherein (A-2) is a warp-knitted fabric wherein both the non-elastic yarn and the elastic yarn are arranged in a 1×1 tricot structure and run in the same direction, and one of the elastic yarn and the non-elastic yarn forms closed loops and the other one forms open loops.

47. The garment according to claim 38, wherein the said other cloth is selected from a group consisting of(B-1), (B-2), (B-3) and (B-4), wherein (B-1) is a warp-knitted fabric wherein the non-elastic yarn is arranged in a 1×1 tricot structure and the elastic yarn is arranged in a half structure;

wherein (B-2) is a warp-knitted fabric wherein the non-elastic yarn is arranged in a 1×1 tricot structure and the elastic yarn is arranged in an atlas structure;

wherein (B-3) is a warp-knitted fabric wherein both the non-elastic yarn and the elastic yarn are arranged in a 1×1 tricot structure and run in the same direction, and both the non-elastic yarn and the elastic yarn form open loops; and wherein (B-4) is a warp-knitted fabric wherein the non-elastic yarn and the elastic yarn run in different directions, and both the non-elastic yarn and the elastic yarn are arranged in a 1×1 tricot structure and form closed loops.

48. The garment according to claim 27, wherein the piece comprises a laminated piece laminated by bonding together a plurality of sheets of at least one cloth selected from a group consisting of(B-1), (B2-), (B-3) and (B-4), wherein (B-1) is a warp-knitted fabric wherein the non-elastic yarn is arranged in a 1×1 tricot structure and the elastic yarn is arranged in a half structure;

wherein (B-2) is a warp-knitted fabric wherein the non-elastic yarn is arranged in a 1×1 tricot structure and the elastic yarn is arranged in an atlas structure;

wherein (B-3) is a warp-knitted fabric wherein both the non-elastic yarn and the elastic yarn are arranged in a 1×1 tricot structure and run in the same direction, and both the non-elastic yarn and the elastic yarn form open loops; and wherein (B-4) is a warp-knitted fabric wherein the non-elastic yarn and the elastic yarn run in different directions, and both the non-elastic yarn and the elastic yarn are arranged in a 1×1 tricot structure and form closed loops.

* * * * *

US007631521C1

(12) EX PARTE REEXAMINATION CERTIFICATE (10016th)

United States Patent

Oya

(10) Number: US 7,631,521 C1

(45) Certificate Issued: Jan. 21, 2014

(54) GARMENT HAVING A WARP-KNITTED FABRIC

(75) Inventor: Kei Oya, Kyoto (JP)

(73) Assignee: Wacoal Corp., Nakajima-cho, Kisshoin, Minami-ku, Kyoto-shi, Kyoto (JP)

Reexamination Request:
No. 90/012,917, Aug. 19, 2013

Reexamination Certificate for:

| | |
|---|---|
| Patent No.: | **7,631,521** |
| Issued: | **Dec. 15, 2009** |
| Appl. No.: | **10/535,082** |
| Filed: | **May 13, 2005** |

(21) Appl. No.: 90/012,917

(22) PCT Filed: Apr. 26, 2004

(86) PCT No.: PCT/JP2004/006015

§ 371 (c)(1), (2), (4) Date: May 13, 2005

(87) PCT Pub. No.: WO2004/100689

PCT Pub. Date: Nov. 25, 2004

(30) Foreign Application Priority Data

May 13, 2003 (JP) ..... 2003-134586
Oct. 29, 2003 (JP) ..... 2003-369540

(51) Int. Cl.

| | |
|---|---|
| ***D04B 1/18*** | (2006.01) |
| ***D04B 1/26*** | (2006.01) |
| ***D04B 9/54*** | (2006.01) |
| ***D04B 9/46*** | (2006.01) |

(52) U.S. Cl.
USPC ..... 66/172 E; 66/195

(58) Field of Classification Search
None
See application file for complete search history.

(56) References Cited

To view the complete listing of prior art documents cited during the proceeding for Reexamination Control Number 90/012,917, please refer to the USPTO's public Patent Application Information Retrieval (PAIR) system under the Display References tab.

*Primary Examiner* — Beverly M. Flanagan

(57) ABSTRACT

A garment that is made including a piece of a stretchable warp-knitted fabric, wherein at least a non-elastic yarn is arranged in a 1×1 tricot structure and an elastic yarn is arranged in a looping structure, that is cut at an angle of at least 3° and at most 177° with respect to the knitting direction, the piece having an edge that does not require hem finishing when left as cut, so that at least one of the edge portions of the garment is formed by an edge that does not require hem finishing when left as cut (an edge of the bottom line 2 or an edge of the waist line 3). Thus, a garment is provided, in which the portion of the edge does not become thick, the edge does not require hem finishing when the fabric is left as cut, this edge is used for the garment's edge portion, curling of the edge portion does not occur, and the edge portion fits the body.

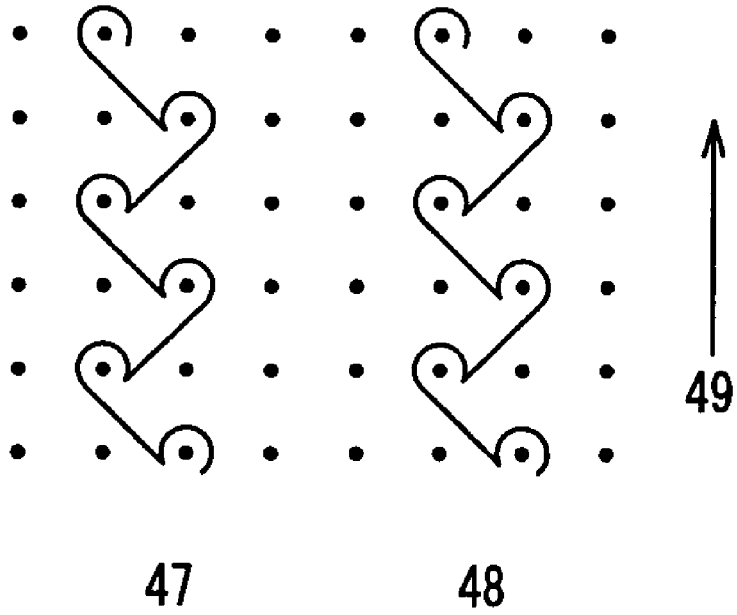

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-48 are cancelled.

* * * * *